US012741305B2

(12) United States Patent
Philipson et al.

(10) Patent No.: US 12,741,305 B2
(45) Date of Patent: Sep. 22, 2026

(54) ROLLING MILL STAND AND METHOD OF CHANGING A WORK ROLL ASSEMBLY THEREOF

(71) Applicant: PRIMETALS TECHNOLOGIES, LIMITED, London (GB)

(72) Inventors: Martin Philipson, Norton (GB); Tom Rodgers, Sheffield (GB); Michal Walczak, Leeds (GB)

(73) Assignee: PRIMETALS TECHNOLOGIES, LIMITED (GB)

( * ) Notice: Subject to any disclaimer, the term of this patent is extended or adjusted under 35 U.S.C. 154(b) by 257 days.

(21) Appl. No.: 18/698,712

(22) PCT Filed: Sep. 14, 2022

(86) PCT No.: PCT/EP2022/075529
§ 371 (c)(1),
(2) Date: Apr. 4, 2024

(87) PCT Pub. No.: WO2023/057182
PCT Pub. Date: Apr. 13, 2023

(65) Prior Publication Data

US 2024/0424542 A1 Dec. 26, 2024

(30) Foreign Application Priority Data

Oct. 5, 2021 (EP) ..... 21201048

(51) Int. Cl.
*B21B 31/10* (2006.01)
*B21B 29/00* (2006.01)

(52) U.S. Cl.
CPC ..... *B21B 31/103* (2013.01); *B21B 29/00* (2013.01); *B21B 31/10* (2013.01); *B21B 31/106* (2013.01)

(58) Field of Classification Search
CPC ..... B21B 31/08; B21B 31/10; B21B 31/103; B21B 31/106
See application file for complete search history.

(56) References Cited

U.S. PATENT DOCUMENTS 3,217,526 A 11/1965 Wilson et al.
3,312,096 A 4/1967 Stubbs et al.
(Continued)

FOREIGN PATENT DOCUMENTS

CN 112474812 A * 3/2021 ..... B21B 31/12
EP 0483599 A2 5/1992

OTHER PUBLICATIONS

International Search Report mailed Dec. 21, 2022 in corresponding PCT International Application No. PCT/EP2022/075529.
(Continued)

*Primary Examiner* — Jared O Brown
(74) *Attorney, Agent, or Firm* — OSTROLENK FABER LLP

(57) ABSTRACT

A rolling mill stand for rolling a metallic product (P') that includes, inter alia: first and second movable rails arranged to allow unimpeded movement of work roll chocks of upper and lower work rolls when in an idle position during rolling operations, and replacement of the upper and lower work rolls when in a service position. Methods are provided for moving the first and second movable rails between the idle position and the service position in order to replace the upper and lower work rolls.

15 Claims, 13 Drawing Sheets

(56) References Cited

U.S. PATENT DOCUMENTS 3,314,263 A * 4/1967 Hill ..... B21B 31/10 72/249
3,446,050 A * 5/1969 O'Brien ..... B21B 31/106 72/239
3,610,013 A 10/1971 Pillon
3,747,387 A * 7/1973 Shumaker ..... B21B 31/10 72/239
3,754,426 A * 8/1973 Adair ..... B21B 31/10 72/238
3,951,268 A * 4/1976 Pell ..... B21B 31/10 211/13.1
4,026,136 A * 5/1977 Pell ..... B21B 31/10 29/281.1
5,195,346 A * 3/1993 Braun ..... B21B 31/106 72/245
5,806,360 A * 9/1998 Dumas ..... B21B 29/00 72/241.8
6,408,667 B1 6/2002 de Jesus, Jr.
2019/0022722 A1* 1/2019 Broeks ..... B21B 13/02
2019/0091744 A1* 3/2019 Broeks ..... B21B 31/103

OTHER PUBLICATIONS

Written Opinion mailed Dec. 21, 2022 in corresponding PCT International Application No. PCT/EP2022/075529.

European Search Report mailed Mar. 4, 2022 in corresponding European Application No. 21201048.2.

Yue, Cui et al.: "Analysis of Displacement Field of the Work Roll Changing Track in Finishing Mill", Metallurgical Equipment, pp. 35-37, doi: 10.3969/j. issn: 1001-1269, Aug. 2016. English translation of the Abstract.

Office Action dated Jun. 16, 2026 issued in corresponding Chinese Patent Application No. 202280067066.5. English translation of CN Search Report.

* cited by examiner

ROLLING MILL STAND AND METHOD OF CHANGING A WORK ROLL ASSEMBLY THEREOF

CROSS-REFERENCE TO RELATED APPLICATIONS

The present application is a 35 U.S.C. §§ 371 national stage application of International Application No. PCT/EP2022/075529, filed Sep. 14, 2022, which claims priority to European Patent Application No. 21201048.2, filed Oct. 5, 2021, the contents of which are incorporated herein by reference.

FIELD OF THE INVENTION

The present invention relates to a rolling mill stand for rolling a metallic product, and a method of changing a work roll assembly of the rolling mill stand.

BACKGROUND

A rolling mill for hot or cold rolling of metals typically comprises one or more rolling mill stands. In a rolling mill stand, a work roll assembly includes two elongate work rolls which are arranged one above the other in a horizontal orientation. The work surfaces of the work rolls are separated by a gap. In use, a roll stock, for example a metallic strip, is formed by the work rolls as it passes through the gap in a generally horizontal orientation and in a direction of travel which is perpendicular to the longitudinal axes of the work rolls.

Correct setting of the gap between the work rolls is fundamental to efficient operation and product quality. The absolute gap must be the correct size in order to achieve the required thickness of the strip. Furthermore it is important to maintain the gap at a uniform size along the length of the work rolls. If the gap size is not substantially uniform along the length, i.e. such that there is a difference in gap size between the left and right sides of the work rolls, the target strip thickness will not be achieved within the desired length at the start of a pass of the strip through the work rolls.

The diameter of each of the work rolls is at a maximum when the work rolls are new. During operational service the working surfaces of the work rolls tend to become worn over time, thus causing the diameter of each work roll to be reduced. As the work rolls progressively wear down the axes of the works rolls must be brought closer together in order to maintain the desired gap between the surfaces of the work rolls. Eventually the work rolls will reach a wear limit at which they are at their minimum diameter. At this stage the work rolls may be removed from the mill stand and replaced by a new pair of work rolls. The worn work rolls are removed from the rolling mill stand in the axial direction, i.e. transverse to the rolling direction of the metallic strip. The removal procedure is then performed in reverse in order to install the replacement work rolls.

It is desirable to change the work roll assembly while the metallic strip is present in the rolling mill. This avoids the need to cut the metallic strip prior to removal of the work roll assembly and to remake the strip following installation of the replacement work roll assembly, thereby advantageously reducing the amount of time taken for replacement and the amount of time that the rolling mill is inactive while the replacement procedure is carried out. In the case of a rolling mill having multiple rolling mill stands, it is also desirable to be able to continue with the rolling of the metallic strip while the work roll assembly of one or more of the rolling mill stands is being replaced. This can avoid altogether the need to remove the strip from the rolling mill in order to replace the work roll assembly of any given rolling mill stand, thereby increasing efficiency of operations.

Changing the work roll assembly while the metallic strip is present in the mill (sometimes called "strip-in-the-mill") requires the work rolls to be separated from the metallic strip before they are drawn out of the rolling mill stand in the transverse direction, so as to avoid damage to the metallic strip or interrupting the rolling of the metallic strip. Designers must therefore devise ways to separate the work rolls from the metallic strip and remove the work rolls from the rolling mill stand. The solution to this problem depends to a large extent on the kinematic configuration of the particular rolling mill stand, since the designs of rolling mill stands vary according to manufacturer and purpose. For example, upper rails or similar may be provided for moving the upper work roll over the metallic strip in the transverse direction. Furthermore, the configuration of a given rolling mill stand can be modified from time to time, for example in order to make improvements to the design and performance of the rolling mill over its lifetime. Some such structural modifications can lead to difficulties in changing the work roll assembly of the rolling mill stand. The present invention aims to alleviate these problems.

US 2019/022722 A1 discloses a rolling mill for rolling metal strips with fixed rails for roll chocks of upper and lower work rolls. Hydraulic bending jacks are provided between roll chocks. Furthermore, a system for clamping the chocks of the working rolls along the axis of the roll, while allowing the chocks to slide along a guide, following the clamping plane including a mechanical unit using the closing movements of the holding cage in order to switch from a retracted position, allowing the withdrawal, along the axis thereof, of the working rolls out of the holding cage, into a locking position, ensuring locking of the chocks.

SUMMARY OF THE INVENTION

According to an aspect of the invention, there is provided a rolling mill stand for rolling a metallic product, comprising: first and second supports spaced apart from each other in an X dimension and each defining a window that extends in a Y dimension which is perpendicular with the X dimension, each window comprising opposing upper channel formations and opposing lower channel formations; upper fixed rails, each extending in the X dimension between a respective one of the opposing upper channel formations of the first support and a respective one of the opposing upper channel formations of the second support; lower fixed rails, each extending in the X dimension between a respective one of the opposing lower channel formations of the first support and a respective one of the opposing lower channel formations of the second support; a work roll assembly comprising an upper work roll and a lower work roll each having a longitudinal axis extending in the X dimension, the upper work roll and the lower work roll being arranged to be spaced apart so as to form a gap for receiving a metallic product for rolling in the Y dimension, two ends of the upper work roll being received by respective upper work roll chocks and two ends of the lower work roll being received by respective lower work roll chocks, each of the upper work roll chocks and the lower work roll chocks comprising bending wings which extend in the Y dimension, each of the bending wings comprising at least one transportation element, each of the bending wings of the upper work roll chock being slidingly received in a respective one of the opposing upper channel formations and each of the bending wings of the lower work roll chock being slidingly received in a respective one of the opposing lower channel formations; work roll bending cylinders each located in one of the opposing upper channel formations or opposing lower channel formations and configured to engage a respective one of the bending wings, each of the work roll bending cylinders being arranged to be selectively extendable and retractable in a Z dimension which is perpendicular with each of the X and Y dimensions in order to raise and lower a respective one of the upper work roll and the lower work roll, wherein with respect to each said window there is provided first and second movable rails located at each of the opposing upper channel formations or at each of the opposing lower channel formations, each of the first and second movable rails being independently movable in the Y dimension between an idle position which is out of alignment with a respective one of the upper or lower fixed rails in the X dimension and a service position which is in alignment therewith in the X dimension, and wherein: when the first and second movable rails are in the idle positions movement of the bending wings in the Z dimension is unimpeded by the first and second movable rails; and when the first and second movable rails are in the service positions the first and second movable rails together with the respective fixed rail form a continuous rail for guiding respective said transportation elements of the bending wings in the X dimension in order to selectively withdraw the work roll assembly from the rolling mill stand and insert the work roll assembly in the rolling mill stand.

The movable rails, which may be conveniently installed in a modified or a new rolling mill stand, provide both an effective means for replacing the work roll assembly (i.e. when the movable rails are in the service position) and unimpeded bending of the work rolls during normal rolling operations (i.e. when the movable rails are in the idle position).

The invention provides for an improved work roll assembly changing procedure, including "strip-in-the-mill" changes. This implies a rapid change of the work roll assembly, which reduces down-time and thus increases productivity of the rolling mill. Another advantage is an improvement in operator efficiency and safety, since there is no need for an operator to de-thread and re-thread the strip of metallic product through the rolling mill stand(s) at each and every work roll change event.

Furthermore, the inventive solution has substantially no impact on the size of the "footprint" of an existing rolling mill stand, since the rail system is contained substantially inside the supports of the stand. Thus the solution is very compact and space-efficient. This is particularly beneficial in respect of "retrofitting" of the rail system to an existing rolling mill, where space for a roll change system may be limited.

With respect to each said window the first and second movable rails may be located at each of the opposing upper channel formations.

With respect to each said window the first and second movable rails may be located at each of the opposing lower channel formations.

Each of the first and second movable rails may be independently movable in the Y dimension: toward the longitudinal axis of the upper work roll or the lower work roll from the idle position to the service position; and away from the longitudinal axis of the upper work roll or the lower work roll from the service position to the idle position.

The rolling mill stand may comprise hydraulic actuators arranged to move the first and second movable rails between the idle position and the service position.

The rolling mill stand may comprise a guide for guiding the first and second movable rails in the Y dimension while resisting movement of the first and second movable rails in the X dimension.

The guide may comprise: one of a complementary ridge and a channel or similar structure provided on a surface of each of said opposing upper channel formations or opposing lower channel formations and extending in the Y dimension; and the other of the complementary ridge and the channel provided on each of the first and second movable rails and extending in the Y dimension, the ridge being received by the channel.

The rolling mill stand may comprise a plurality of extension rails each extending in the X dimension from one of the first and second supports, each of the extension rails being in alignment and in end-to-end abutment with one of said continuous rails and being configured to guide said respective said transportation elements.

The extension rails may form an integral part of said one of the first and second supports.

The extension rails may form parts of a carriage which is movable in the X dimension such as bring the extension rails into said alignment and end-to-end abutment with said continuous rails.

The at least one transportation element may comprise a wheel.

According to another aspect of the invention, there is provided a method of changing a work roll assembly of a rolling mill stand as described herein above, wherein with respect to each said window the first and second movable rails are located at each of the opposing upper channel formations, the method comprising: controlling the work roll bending cylinders which are located in the opposing lower channel formations and which are in engagement with the bending wings of the lower work roll chocks to be retracted, thereby to lower the lower work roll in the Z dimension so as to separate the lower work roll from the metallic product and to bring each of the transportation elements of the lower work roll chocks into contact with a respective one of the lower fixed rails; controlling the work roll bending cylinders which are located in the opposing upper channel formations and which are in engagement with the bending wings of the upper work roll chocks to be extended, thereby to raise the upper work roll in the Z dimension so as to separate the upper work roll from the metallic product and to bring each of the transportation elements of the upper work roll to a greater height than the respective first movable rail; controlling each first movable rail to move from the idle position into the service position; controlling the work roll bending cylinders which are located in the opposing upper channel formations and which are in engagement with the bending wings of the upper work roll chocks to be retracted, thereby to lower the upper work roll in the Z dimension to bring each of the transportation elements of the upper work roll chocks into contact with a respective one of the first movable rails; controlling each second movable rail to move from the idle position into the service position; applying a force to the work roll assembly in the X dimension in order to guide each of the transportation elements along a respective one of the continuous rails or a respective one of the lower fixed rails, thereby to withdraw the work roll assembly from the rolling mill stand; providing a replacement work roll assembly; applying a force to the replacement work roll assembly in the X dimension in order to guide each of the transportation elements along a respective one of the continuous rails or a respective one of the lower fixed rails, thereby to insert the replacement work roll assembly into the rolling mill stand; controlling each second movable rail to move from the service position into the idle position; controlling the work roll bending cylinders which are located in the opposing upper channel formations to be extended, thereby to engage with the bending wings of the upper work roll chocks to raise the upper work roll in the Z dimension so as to lift each of the transportation elements of the upper work roll off the respective first movable rail; controlling each first movable rail to move from the service position into the idle position; controlling the work roll bending cylinders which are located in the opposing upper channel formations and which are in engagement with the bending wings of the upper work roll chocks to be retracted, thereby to lower the upper work roll in the Z dimension to bring the upper work roll into contact with the metallic product; and controlling the work roll bending cylinders which are located in the opposing lower channel formations to be extended, thereby to engage with the bending wings of the lower work roll chocks to raise the lower work roll in the Z dimension so as to lift each of the transportation elements of the lower work roll off the respective one of the lower fixed rails and to bring the lower work roll into contact with the metallic product.

According to another aspect of the invention, there is provided a method of changing a work roll assembly of a rolling mill stand as described herein above, wherein with respect to each said window the first and second movable rails are located at each of the opposing lower channel formations, the method comprising: controlling the work roll bending cylinders which are located in the opposing upper channel formations and which are in engagement with the bending wings of the upper work roll chocks to be retracted, thereby to lower the upper work roll in the Z dimension so as bring each of the transportation elements of the upper work roll chocks into contact with a respective one of the upper fixed rails; controlling the work roll bending cylinders which are located in the opposing lower channel formations and which are in engagement with the bending wings of the lower work roll chocks to be retracted, thereby to lower the lower work roll in the Z dimension so as to separate the lower work roll from the metallic product and to allow the metallic product to sag so as to separate from the upper work roll; controlling the work roll bending cylinders which are located in the opposing lower channel formations and which are in engagement with the bending wings of the lower work roll chocks to be retracted or extended, thereby to bring each of the transportation elements of the lower work roll chocks to a greater height than the respective first movable rail; controlling each first movable rail to move from the idle position into the service position; controlling the work roll bending cylinders which are located in the opposing lower channel formations and which are in engagement with the bending wings of the lower work roll chocks to be retracted, thereby to lower the lower work roll in the Z dimension to bring each of the transportation elements of the lower work roll chocks into contact with a respective one of the first movable rails; controlling each second movable rail to move from the idle position into the service position; applying a force to the work roll assembly in the X dimension in order to guide each of the transportation elements along a respective one of the continuous rails or a respective one of the lower fixed rails, thereby to withdraw the work roll assembly from the rolling mill stand; providing a replacement work roll assembly; applying a force to the replacement work roll assembly in the X dimension in order to guide each of the transportation elements along a respective one of the continuous rails or a respective one of the upper fixed rails, thereby to insert the replacement work roll assembly into the rolling mill stand; controlling the work roll bending cylinders which are located in the opposing upper channel formations to be extended, thereby to engage with the bending wings of the upper work roll chocks to raise the upper work roll in the Z dimension so as to lift each of the transportation elements of the upper work roll off the respective one of the upper fixed rails; controlling each second movable rail to move from the service position into the idle position; controlling the work roll bending cylinders which are located in the opposing lower channel formations to be extended, thereby to engage with the bending wings of the lower work roll chocks to raise the lower work roll in the Z dimension so as to lift each of the transportation elements of the lower work roll off the respective first movable rail; controlling each first movable rail to move from the service position into the idle position; and controlling the work roll bending cylinders which are located in the opposing lower channel formations and which are in engagement with the bending wings of the lower work roll chocks to be extended, thereby to raise the lower work roll in the Z dimension to bring the lower work roll into contact with the metallic product and to move the metallic product into contact with the upper work roll.

With regard to each of the two methods described herein above, the metallic product may be stationary in the Y dimension with respect to the rolling mill stand.

With regard to each of the two methods described herein above, the metallic product may be in motion in the Y dimension with respect to the rolling mill stand.

BRIEF DESCRIPTION OF THE DRAWINGS

The invention will now be described, by way of example, with reference to the accompanying figures in which.

DETAILED DESCRIPTION

Figure 1A:
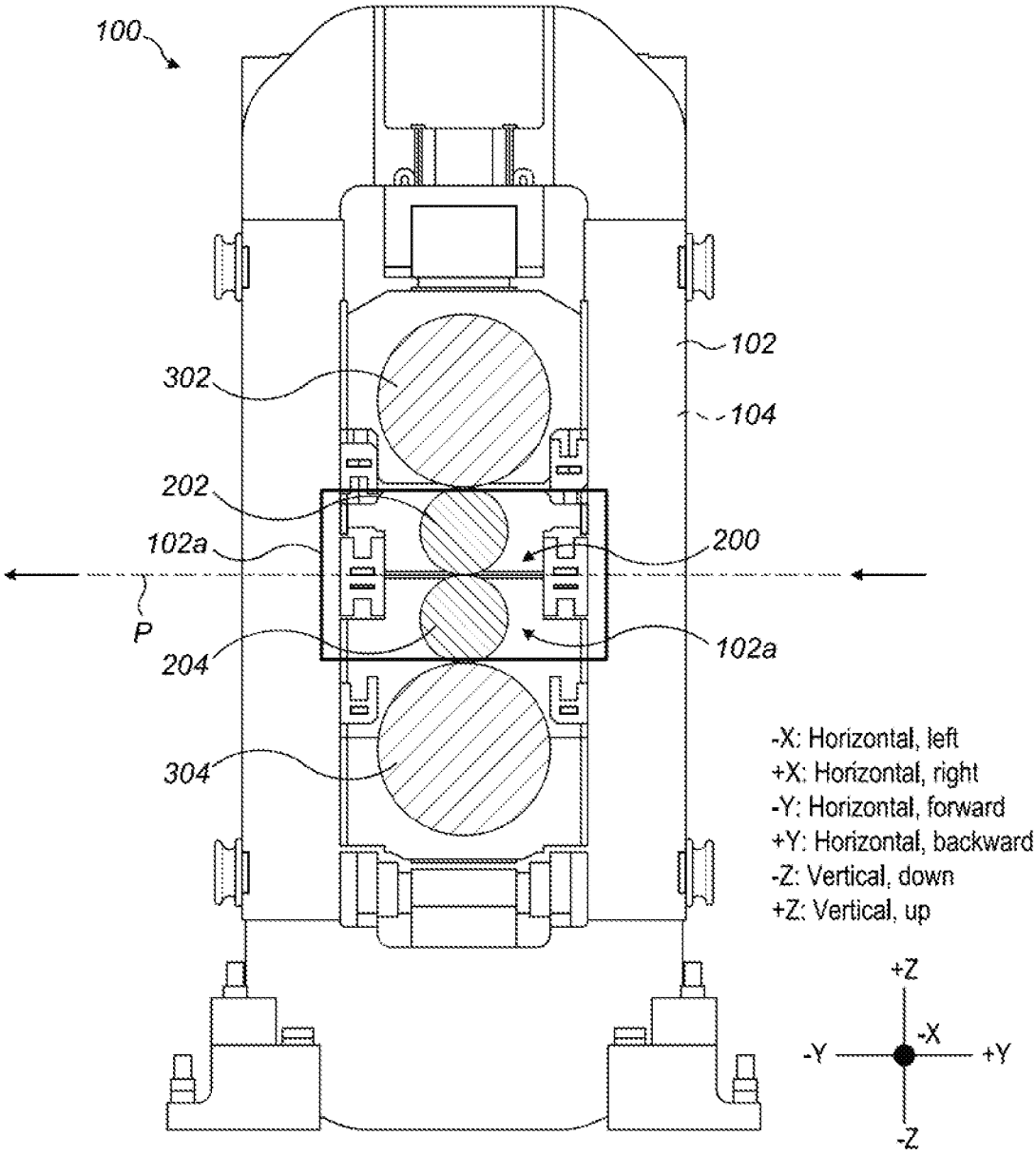
FIG. 1a (Prior Art)
FIGS. 1*a-c* show a conventional rolling mill stand and a work roll assembly thereof.
Figure 1B:
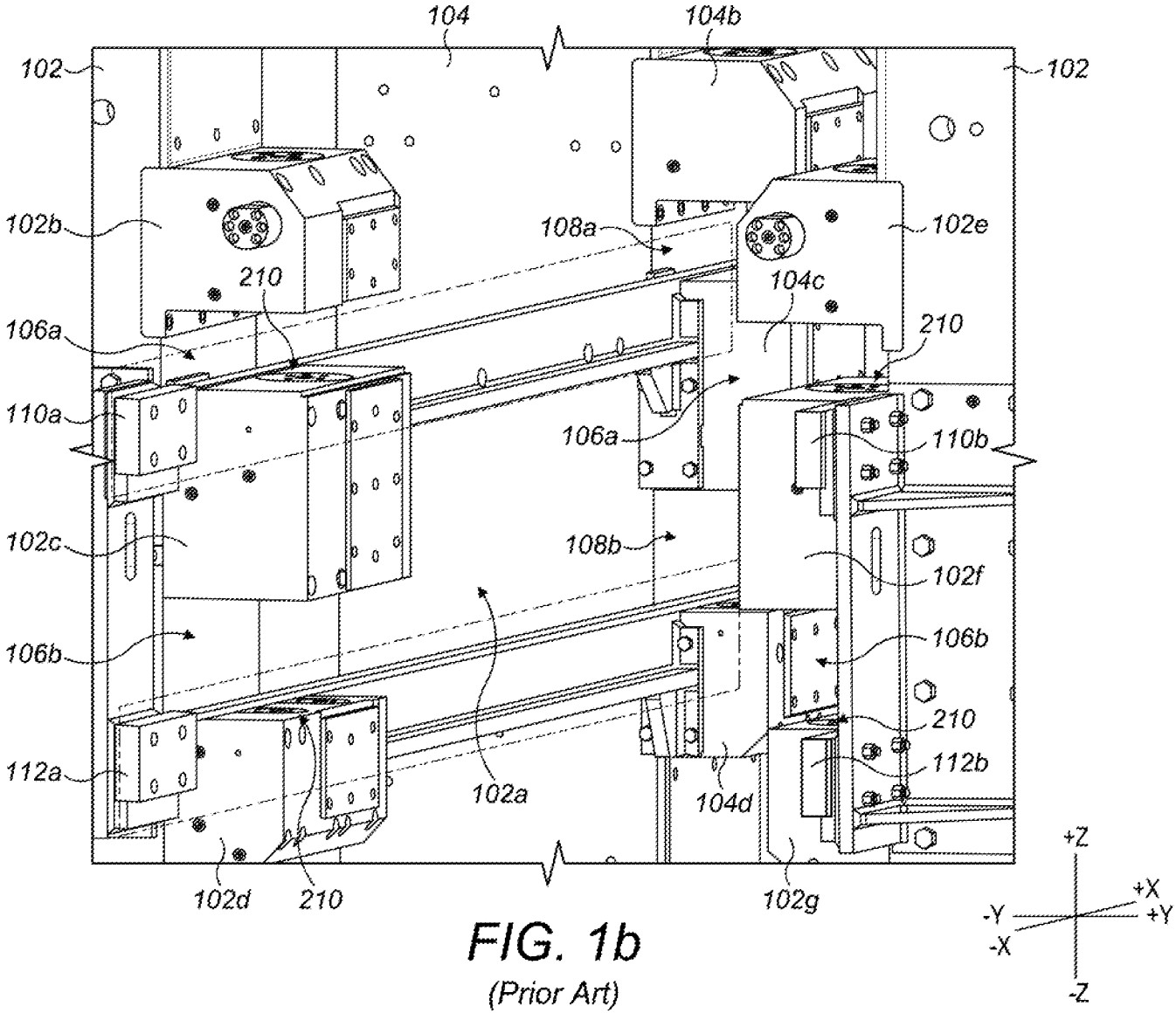
FIG. 1b (Prior Art)
Figure 1C:
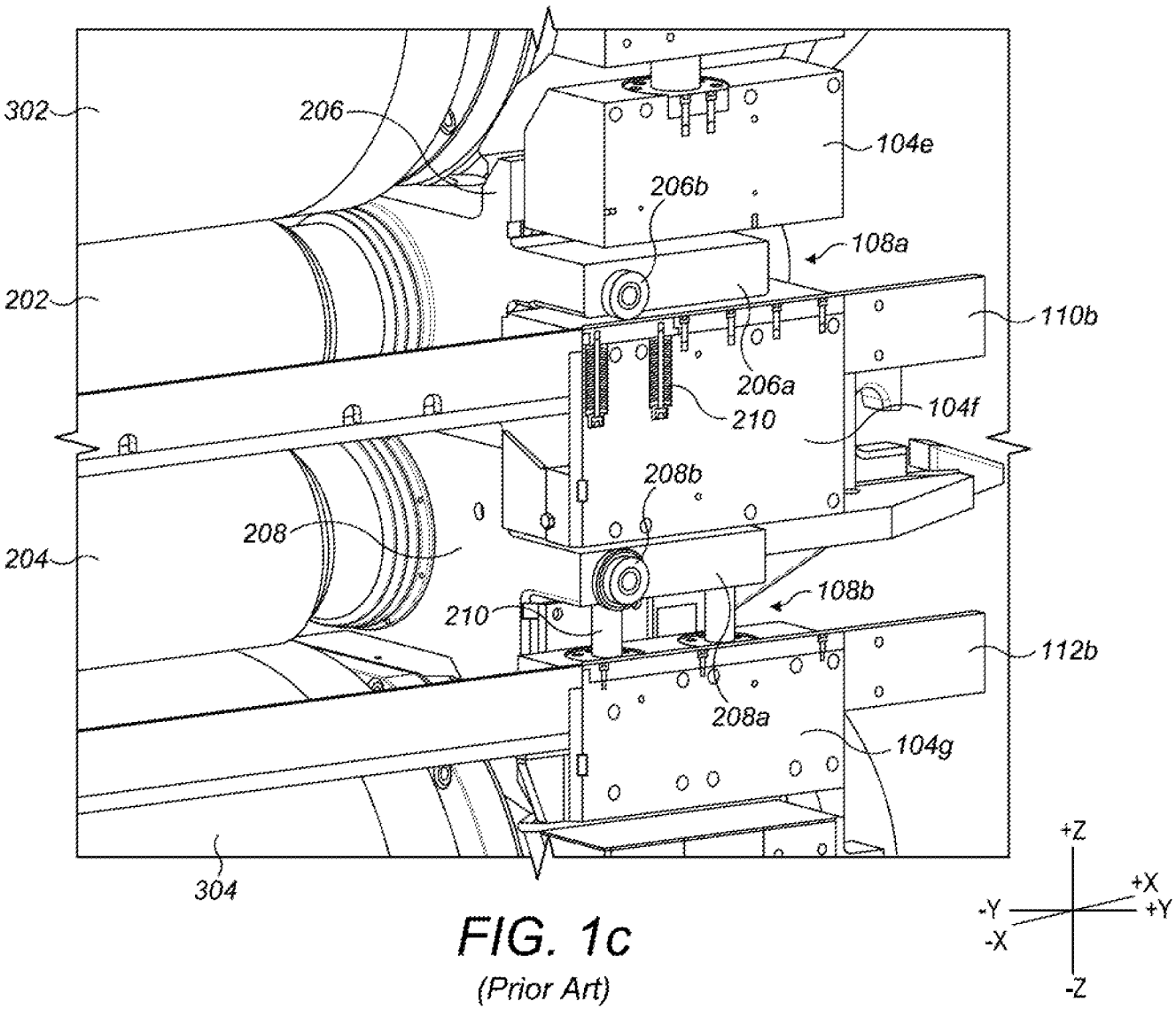
FIG. 1c (Prior Art)

Referring to FIGS. 1*a-c*, a conventional rolling mill stand 100 of a rolling mill comprises first and second vertically-extending (i.e. in the Z dimension in the sense of FIGS. 1*a-d*) support members 102, 104 which are laterally spaced-apart (i.e. in the X dimension) such as to be in parallel relationship with each other (i.e. in the Y dimension). The first support member 102 is at an operating side (or non-drive side) of the rolling mill stand 100 and the second support member 104 is at a drive side thereof. Each of the first and second support members 102, 104 comprises a thick, generally rectangular plate having an elongate opening or aperture or window 102*a*, 104*a* which extends along the support member 102, 104 (i.e. in the Y dimension) and through the support member 102, 104 (i.e. in the X dimension).

Referring in particular to FIG. 1*b*, at a mid-portion of the window 102*a* of the first support member 102 there is provided a plurality of support blocks (or bending/balance blocks) 102*b-g* that project inwardly into the window 102*a* (i.e. in the Y dimension) so as to define opposing upper channel formations 106*a* and opposing lower channel formations 106*b*. Similarly, at a mid-portion of the window 104*a* (not visible in FIG. 1*b*) of the second support member 104 there is provided a plurality of support blocks 104*b-g* that project inwardly into the window 104*a* (i.e. in the Y dimension) so as to define opposing upper channel formations 108*a* and opposing lower channel formations 108*b*. As can be seen in FIG. 1*b*, each group 102*b-d*, 102*e-g*; 104*b-d*, 104*e-g* of the support blocks 102, 104 defines an "E" shape which may be called an "E" block.

Still referring to FIG. 1*b* and also FIG. 1*c*, a first upper rail 110*a* extends (i.e. in the X dimension) between a respective one of the support blocks 102*c* of the first support member 102 and a respective one of the support blocks 104*c* of the second support member 104. Similarly, a second upper rail 110*b* extends (i.e. in the X dimension) between another respective one of the support blocks 102*f* of the first support member 102 and another respective one of the support blocks 104*f* of the second support member 104. Thus the first upper rail 110*a* and the second upper rail 110*b* are arranged in parallel with each other and each extends (i.e. in the X dimension) between a respective one of the opposing upper channel formations 106*a* of the first support member 102 and a respective one of the opposing upper channel formations 108*a* of the second support member 104.

In a similar manner, a first lower rail 112*a* extends (i.e. in the X dimension) between a respective one of the support blocks 102*d* of the first support member 102 and a respective one of the support blocks 104*d* of the second support member 104. Similarly, a second lower rail 112*b* extends (i.e. in the X dimension) between another respective one of the support blocks 102*g* of the first support member 102 and another respective one of the support blocks 104*g* of the second support member 104. Thus the first lower rail 112*a* and the second lower rail 112*b* are arranged in parallel with each other and each extends (i.e. in the X dimension) between a respective one of the opposing lower channel formations 106*b* of the first support member 102 and a respective one of the opposing lower channel formations 108*b* of the second support member 104.

Each of the first and second upper rails 110*a*, 110*b* and the first and second lower rails 112*a*, 112*b* is fixed relative to the said support blocks and the remainder of the structure of the rolling mill stand 100. That is, each of the first and second upper rails 110*a*, 110*b* and the first and second lower rails 112*a*, 112*b* is immovable in each of the X, Y and Z dimensions.

The rolling mill stand 100 further comprises four extension rails (not shown in the Figures) which project outwardly from one of the first and second support members 102, 104 (i.e. in the X dimension and in one of the −X and +X directions) such that each one of the four extension rails aligns with (i.e. in the X dimension) and is in end-to-end abutment with one of the first and second upper rails 110*a*, 110*b* or one of the first and second lower rails 112*a*, 112*b*. Alternatively, there is provided a separate carriage comprising four extension rails, the carriage being movable (i.e. in the X dimension) to bring each of the four extension rails into end-to-end abutment and alignment (i.e. in the X dimension and in one of the −X and +X directions) with one of the first and second upper rails 110*a*, 110*b* or one of the first and second lower rails 112*a*, 112*b*. In each case, the four extension rails are constructed from steel.

Referring now in particular to FIGS. 1*a* and 1*c*, the rolling mill stand 100 further comprises a work roll assembly 200 comprising an upper work roll 202 and a lower work roll 204 each having a longitudinal axis extending between the first support member 102 and the second support member 104 (i.e. in the X dimension). The upper work roll 202 and the lower work roll 204 are arranged to be spaced apart so as to form a gap for receiving a metallic product P for rolling in a direction (as indicated by the arrows in FIG. 1*a*) which is perpendicular with the longitudinal axes of the upper and lower work rolls 202, 204 (i.e. in the −Y direction in the sense of FIGS. 1*a* and 1*d*).

Each of the two ends of the upper work roll 202 is received and supported by a respective upper work roll chock 206. Each of the upper work roll chocks 206 comprises on opposite sides thereof a flange portion or bending wing 206*a* which extends perpendicularly with the longitudinal axis of the upper work roll 202 (i.e. in the Y dimension) and which is received by the opposing upper channel formations 106*a*. Similarly, each of the two ends of the lower work roll 204 is received and supported by a respective lower work roll chock 208. Each of the lower work roll chocks 208 comprises on opposite sides thereof a flange portion or bending wing 208*a* which extends perpendicularly with the longitudinal axis of the lower work roll 204 (i.e. in the Y dimension) and which is received by the opposing upper channel formations 106*b*.

Each of the upper work roll chocks 206 and the lower work roll chocks 208 comprises a wheel 206*b*, 208*b* which extends from the chock and which has a rotational axis that extends perpendicularly with the longitudinal axis of the upper work roll 202 or the lower work roll 204 respectively (i.e. in the Y dimension). Each of the wheels is configured to engage an upper surface of a respective one of the first and second upper rails 110*a*, 110*b* and the first and second lower rails 112*a*, 112*b*.

Referring now in particular to FIGS. 1*b* and 1*c*, the rolling mill stand 100 further comprises work roll bending cylinders 210 each provided in a respective one of the support blocks 102*b-g*, 104*b-g* such as to be located at or in one of the opposing upper channel formations 106*a* or opposing lower channel formations 106*b*. Each of the work roll bending cylinders 210 is configured to engage a respective one of the bending wings 206*a*, 208*a* and to be selectively extendable and retractable in the vertical direction (i.e. in the Z dimension) in order to raise and lower a respective one of the upper work roll 202 and the lower work roll 204. It will be understood by the skilled person that the work roll bending cylinders 210 function to control the gap (or roll bite) between the upper and lower work rolls 202, 204 during rolling operations.

Still referring in particular to FIGS. 1*a* and 1*c*, the upper and lower work rolls 202, 204 are each supported by a respective backup roll 302, 304. The longitudinal axes of the upper and lower work rolls 202, 204 and the backup rolls 302, 304 lie in a single, common plane (a vertical plane, in the sense of FIGS. 1*a* and 1*c*). Hydraulic roll load cylinders (not shown in the Figures) are arranged to apply a rolling force to the upper work roll 202 via its respective backup roll 302. The position of the lower work roll 204 and its respective backup roll 304 may be set, for example, by a pair of wedges located at the base of the rolling mill stand 100. The upper and lower work rolls 202, 204 are constructed from steel. (The conventional rolling mill stand 100 of FIGS. 1*a-d* is a typical hot mill arrangement. In cold mills the hydraulic roll load cylinders are often at the bottom and the wedges are at the top. Thus the skilled person will understand that the positions of the wedges and hydraulic roll load cylinders may be reversed).

The upper and lower work rolls 202, 204 will tend to become worn during rolling operations and they are therefore periodically removed from the rolling mill stand 100 for replacement. The procedure for removing the work roll assembly 200 is as follows.

The strip of metallic product P is cut or severed at each side of the work roll assembly 200 (i.e. in the Y dimension) in order to release the work roll assembly 200 from the tension of the strip of metallic product P.

The work roll bending cylinders 210 are controlled to be retracted downwardly (i.e. in the −Z direction) into the respective support blocks 102*b-g*, 104*b-g*. Accordingly the upper and lower work rolls 202, 204 are lowered (i.e. in the −Z direction) so that each of the wheels of the upper work roll chocks 206 and the lower work roll chocks 208 comes into resting contact with the upper surface of a respective one of the first and second upper rails 110*a*, 110*b* or the first and second lower rails 112*a*, 112*b*.

A pushing or pulling force is applied to the work roll assembly 200 in the axial direction (i.e. in the +X or −X direction), for example manually by an operator or by automated means, in order to withdraw the work roll assembly 200 from the side of the rolling mill stand along the four extension rails. Once the work roll assembly 200 is clear of the rolling mill stand 100 (i.e. in the X dimension), it may be displaced out of the way (i.e. in the Y dimension) in order to make way for a replacement work roll assembly 200 to be inserted into the rolling mill stand 100. The procedure for the insertion of the new work roll assembly 200 may be the reverse of the removal procedure.

The rolling mill stand 100 described herein above may be a single-stand or may be one of a plurality of similar rolling mill stands in a rolling mill. The rolling mill may be for hot or cold rolling.

With regard to the kind of rolling mill stand 100 described herein above, the present inventors have found that it is beneficial over the course of time to make structural modifications, for example in respect of the upper and lower support members 102, 104, the upper and lower work roll chocks 206, 208, and/or the upper and lower work rolls 202, 204, in order to make general improvements to the design and performance of the rolling mill over its lifetime. As well as evolutionary designs for future rolling mills, this may include "retrofitting" existing rolling mill stands with upper and lower support members 102, 104, upper and lower work roll chocks 206, 208, and/or upper and lower work rolls 202, 204 having modified size, shape, geometry, strength, material, and so on.

Furthermore, in some rolling mill configurations the spacing between the individual rolling mill stands may be irregular, such that some of the rolling mill stands are closer together (i.e. in the Y dimension) than are others of the rolling mill stands 100. Thus the above-mentioned displacement (i.e. in the Y dimension) of the work roll 200 assembly after its removal from the rolling mill stand, in order to clear the way for the replacement work roll 200 assembly to be inserted (i.e. in the X dimension) into the rolling mill stand 100, may be problematic due to a lack of space (i.e. in the Y dimension) between two adjacent rolling mill stands 100. In such cases, one solution might be to shorten (i.e. in the Y dimension) the bending wings 206*a*, 208*a* of the upper and lower work roll chocks 206, 208 in order to provide more space. This may then necessitate redesign or relocation of some other parts of the rolling mill stand 100, for example the size or geometry of the opposing upper channel formations 106*a* and opposing lower channel formations 106*b* and the location of the work roll bending cylinders 210.

The present inventors have found that the factors described above relating to modifications to the rolling mill stand 100 can cause difficulties with regard to the parts of the rolling mill stand 100 that facilitate the removal and replacement of the work roll assembly 200, as follows.

Figure 1D:
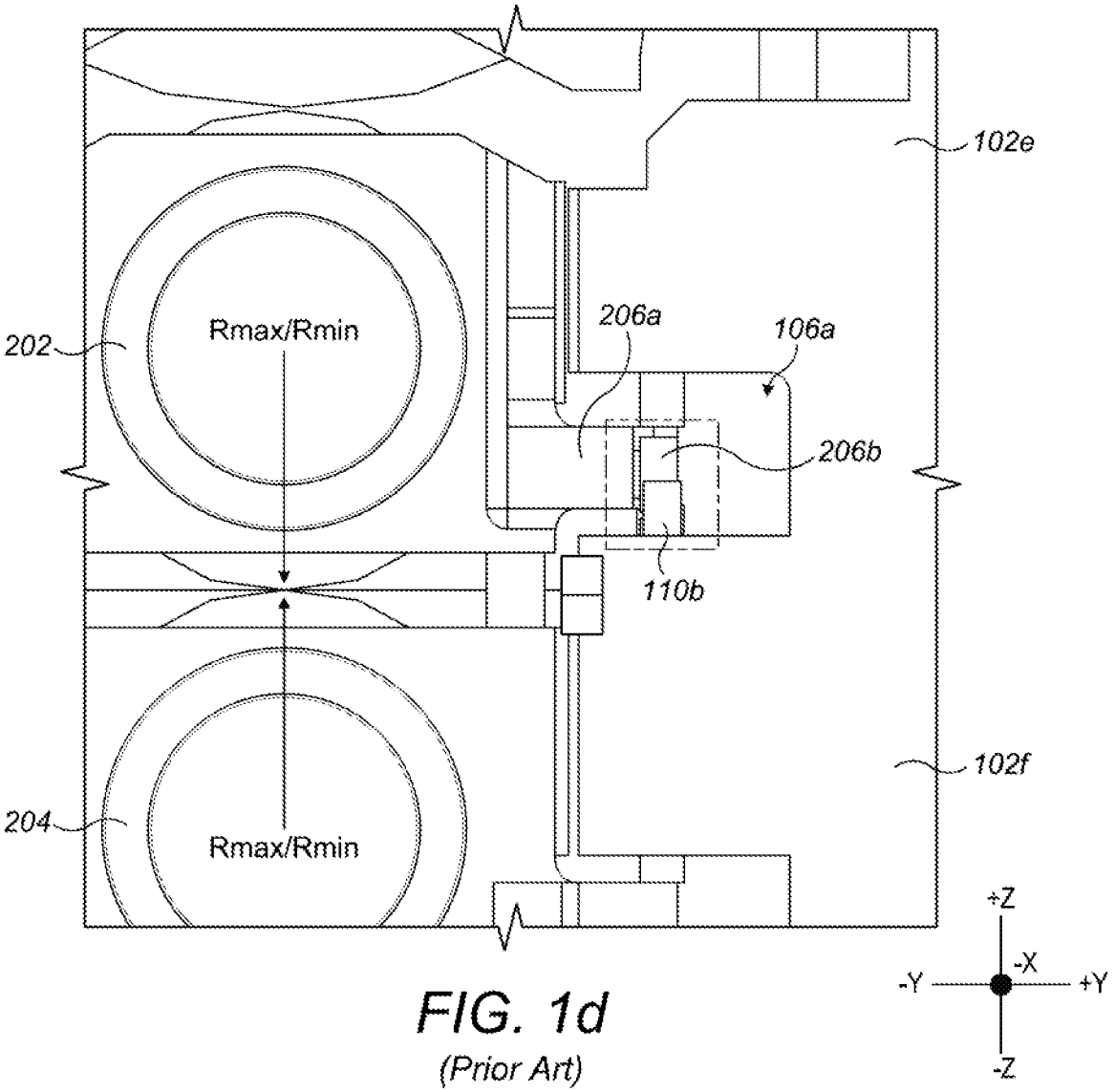
FIG. 1d (Prior Art)
FIG. 1*d* shows a modified version of the conventional rolling mill stand.

Referring to FIG. 1*d*, when in a new condition each of the upper work roll 202 and the lower work roll 204 has a maximum diameter or radius Rmax, whereas when in a fully worn condition each of the upper work roll 202 and the lower work roll 204 has a minimum diameter or radius Rmin. Each of the upper work roll 202 and the lower work roll 204 will wear over time, resulting in a progressive transition from the maximum diameter or radius Rmax to the maximum diameter or radius Rmin. As a result the gap between the upper and lower work rolls 202, 204 tends to grow larger. Thus the respective work roll bending cylinders 210 are controlled to move the upper and lower work rolls 202, 204 (i.e. in the Z dimension) so that their longitudinal axes are brought closer together in order to maintain the gap at the correct size for rolling the metallic product P.

As represented in FIG. 1*d*, at some stage in the transition between maximum and minimum work roll diameter it may become impossible to move the longitudinal axes of the upper and lower work rolls 202, 204 any closer together because each of the wheels 206*b* of the upper work roll chocks 206 impacts a respective one of the first and second upper rails 110*a*, 110*b*. Thus further movement of the upper work roll 202 toward the lower work roll 204 is prevented. This potential "clash" between the wheels 206*b* and the first and second upper rails 110*a*, 110*b* may arise as a result of the kinds of rolling mill stand modifications described herein above. This difficulty must be resolved in order to realise the benefits of the modifications and to enable the work roll assembly 200 to be conveniently and efficiently replaced when the upper and lower work rolls 202, 204 have reached their design minimum diameter.

Referring now to FIGS. 2*a*-6, a rolling mill stand 400 according to the invention has some structural features which are broadly similar to those of the conventional "E" block rolling mill stand 100 described herein above and some other features which are different and which overcome the above-mentioned difficulties.

Thus the inventive rolling mill stand 400 comprises first and second vertically-extending (i.e. in the Z dimension in the sense of FIGS. 2*a*-6) support members 402, 404 which are laterally spaced-apart (i.e. in the X dimension) such as to be in parallel relationship with each other (i.e. in the Y dimension). The first support member 402 is at an operating side (or non-drive side) of the rolling mill stand 400 and the second support member 404 is at a drive side thereof. Each of the first and second support members 402, 404 comprises a thick, generally rectangular plate having an elongate opening or aperture or window 402*a*, 404*a* which extends along the support member 402, 404 (i.e. in the Y dimension) and through the support member 402, 404 (i.e. in the X dimension). In this example, each of the first and second support members 402, 404 is constructed from steel.

Figure 2A:
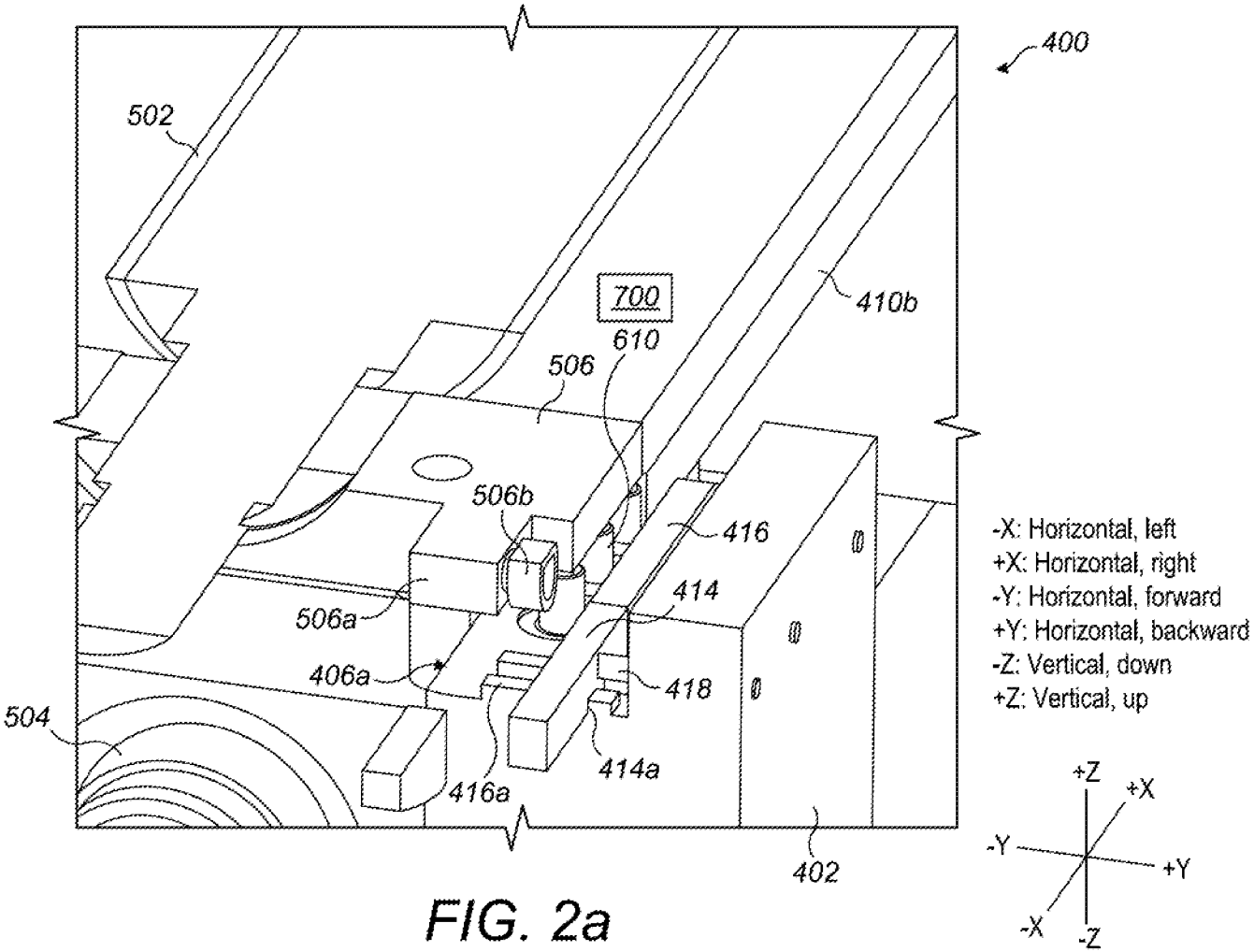
FIGS. 2*a*-6 show a rolling mill stand and a work roll assembly thereof according to the invention.
Figure 2B:
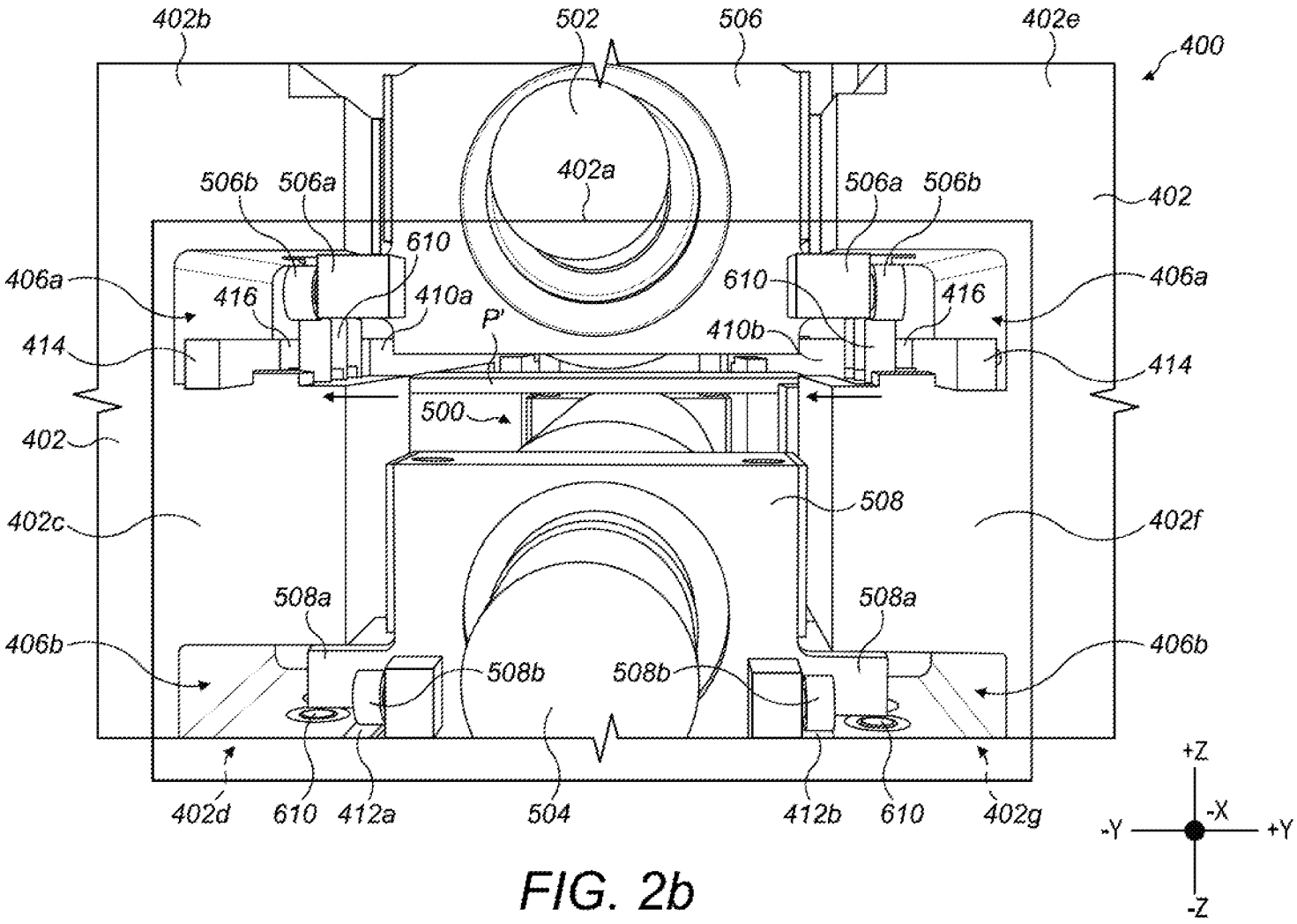

Referring in particular to FIG. 2*b*, at a mid-portion of the window 402*a* of the first support member 402 there is provided a plurality of support blocks 402*b-g* that project inwardly into the window 402*a* (i.e. in the Y dimension) so as to define opposing upper channel formations 406*a* and opposing lower channel formations 406*b*. Similarly, at a mid-portion of the window 404*a* (not visible in FIG. 2*b*) of the second support member 404 there is provided a plurality of support blocks 404*b-g* that project inwardly into the window 404*a* (i.e. in the Y dimension) so as to define opposing upper channel formations 408*a* and opposing lower channel formations 408*b*. As can be seen in FIG. 2*b*, each group 402*b-d*, 402*e-g*; 404*b-d*, 404*e-g* of the support blocks 402, 404 defines an "E" shape which may be called an "E" block.

Still referring to FIG. 2*b* and also FIG. 2*a*, a first upper fixed rail 410*a* extends (i.e. in the X dimension) between a respective one of the support blocks 402*c* of the first support member 402 and a respective one of the support blocks 404*c* of the second support member 404 (not visible in FIGS. 2*a* and 2*b*). A second upper fixed rail 410*b* extends (i.e. in the X dimension) between another respective one of the support blocks 402*f* of the first support member 402 and another respective one of the support blocks 404*f* of the second support member 404 (not visible in FIGS. 2*a* and 2*b*). Thus the first upper fixed rail 410*a* and the second upper fixed rail 410*b* are arranged in parallel with each other and each extends (i.e. in the X dimension) between a respective one of the opposing upper channel formations 406*a* of the first support member 402 and a respective one of the opposing upper channel formations 408*a* of the second support member 404. Each of the first upper fixed rail 410*a* and the second upper fixed rail 410*b* extends only partially into the respective opposing upper channel formations 406*a* (i.e. in the X dimension) such as to extend less than the full width of the rolling mill stand 400.

In a similar manner, a first lower fixed rail 412*a* extends (i.e. in the X dimension) between a respective one of the support blocks 402*d* of the first support member 402 and a respective one of the support blocks 404*d* of the second support member 404 (not visible in FIGS. 2*a* and 2*b*). Similarly, a second lower fixed rail 412*b* extends (i.e. in the X dimension) between another respective one of the support blocks 402*g* of the first support member 402 and another respective one of the support blocks 404*g* of the second support member 404 (not visible in FIGS. 2*a* and 2*b*). Thus the first lower fixed rail 412*a* and the second lower fixed rail 412*b* are arranged in parallel with each other and each extends (i.e. in the X dimension) between a respective one of the opposing lower channel formations 406*b* of the first support member 402 and a respective one of the opposing lower channel formations 408*b* of the second support member 404. Each of the first lower fixed rail 412*a* and the second lower fixed rail 412*b* extends substantially the full width of the rolling mill stand 400 (i.e. in the X dimension).

Each of the first and second upper fixed rails 410*a*, 410*b* and the first and second lower fixed rails 412*a*, 412*b* is fixed relative to the said support blocks and the remainder of the structure of the rolling mill stand 400. That is, each of the first and second upper fixed rails 410*a*, 410*b* and the first and second lower fixed rails 412*a*, 412*b* is immovable in each of the X, Y and Z dimensions.

Still referring in particular to FIG. 2*b* and also FIG. 2*a*, at each window 402*a*, 404*a* of the first and second support members 402, 404 there is provided first and second movable rails 414, 416 each located at a respective one of the support blocks 402*c*, 402*f* so as to be positioned within a respective one of the opposing upper channel formations 406*a*. Each of the first and second movable rails 414, 416 is elongate and extends in the X dimension. As shown in FIGS. 2*a* and 2*b*, each of the first and second movable rails 414, 416 is in an idle position such as to be offset from (i.e. in the Y dimension) and out of alignment with (i.e. in the X dimension) a respective one of the upper fixed rails 412*a*. In the idle position each of the first and second movable rails 414, 416 is parallel with a respective one of the upper fixed rails 412*a*. In this example, in the idle position each of the first and second movable rails 414, 416 is located outboard (i.e. further in the +Y or −Y direction) of the respective one of the upper fixed rails 412*a*.

In this example, all of the first and second upper fixed rails 410*a*, 410*b*, the first and second lower fixed rails 412*a*, 412*b*, and the first and second movable rails 414, 416 are constructed from steel.

In this example, each of the first and second movable rails 414, 416 is connected to a respective hydraulic rod or piston 418 which extends from a respective outboard portion of the first support member 402 in the Y dimension (i.e. perpendicularly with the respective first and second movable rail 414, 416). Each hydraulic piston 418 is configured to be controllable to be extended in order to drive the respective first or second movable rail 414, 416 (i.e. in the Y dimension) from the idle position to a service position such as to be in alignment with (i.e. in the X dimension) a respective one of the upper fixed rails 412*a*. In the service position, respective ones of the first and second movable rails 414, 416 together with a respective one of the upper fixed rails 412*a* forms a continuous rail which extends substantially the full width of the rolling mill stand 400 (i.e. in the X dimension). Each hydraulic piston 418 is further configured to be controllable to be retracted in order to drive the respective first or second movable rail 414, 416 (i.e. in the Y dimension) from the service position to the idle position.

Thus each of the first and second movable rails 414, 416 is independently movable (i.e. in the Y dimension) between the idle position wherein the first and second movable rail 414, 416 is out of alignment (i.e. in the X dimension) and parallel with a respective one of the upper fixed rails 412*a*, and a service position wherein the first and second movable rail 414, 416 is in alignment (i.e. in the X dimension) with the respective one of the upper fixed rails 412*a*. Furthermore, in this example the first and second movable rails 414, 416 are independently movable in a reciprocating motion between the idle position and the service position according to the action of the extending and retracting hydraulic pistons. In this example, each of the first and second movable rails 414, 416 is immovable in each of the X and Z dimensions.

In this example, an underside of each of the first and second movable rails 414, 416 is provided with channels 414*a* which extend transversely across the first or second movable rail 414, 416 (i.e. in the Y dimension). Furthermore an upper surface of each of the respective support blocks 402*c*, 402*f* is provided with complementary ridges 416*a* which extend in the same direction as the channels 414*a* (i.e. in the Y dimension) and are (i.e. in the Y dimension) snugly received in the respective channel 414*a*. Thus the channels 414*a* and ridges 416*a* function as guides which allow and assist movement of the first and second movable rails 414, 416 between the idle position and the service position in the Y dimension while resisting movement thereof in the X dimension.

Still referring in particular to FIGS. 2*a* and 2*b*, the rolling mill stand 400 further comprises a work roll assembly 200 comprising an upper work roll 502 and a lower work roll 504 each having a longitudinal axis extending between the first support member 402 and the second support member 404 (i.e. in the X dimension). The upper work roll 502 and the lower work roll 504 are arranged to be spaced apart so as to form a gap for receiving a metallic product P' for rolling in a direction (as indicated by the arrows in FIG. 2*b*) which is perpendicular with the longitudinal axes of the upper and lower work rolls 502, 504 (i.e. in the −Y direction in the sense of FIGS. 2*a* and 2*b*).

Each of the two ends of the upper work roll 502 is received and supported by a respective upper work roll chock 506. Each of the upper work roll chocks 506 comprises on opposite sides thereof a flange portion or bending wing 506*a* which extends perpendicularly with the longitudinal axis of the upper work roll 502 (i.e. in the Y dimension) and which is received by the opposing upper channel formations 406*a*. Similarly, each of the two ends of the lower work roll 504 is received and supported by a respective lower work roll chock 508. Each of the lower work roll chocks 508 comprises on opposite sides thereof a flange portion or bending wing 508*a* which extends perpendicularly with the longitudinal axis of the lower work roll 504 (i.e. in the Y dimension) and which is received by the opposing upper channel formations 406*b*.

Each of the upper work roll chocks 506 and the lower work roll chocks 508 comprises a wheel 506*b*, 508*b* which extends from the chock and which has a rotational axis that extends perpendicularly with the longitudinal axis of the upper work roll 502 or the lower work roll 504 respectively (i.e. in the Y dimension). Each of the wheels 506*b* of the upper work roll chocks 506 is configured to engage an upper surface of a respective one of the first and second upper fixed rails 410*a*, 410*b* and upper surfaces of a respective two of the first and second movable rails 414, 416. Each of the wheels 508*b* of the lower work roll chocks 508 is configured to engage an upper surface of a respective one of the first and second lower fixed rails 412*a*, 412*b*.

Still referring in particular to FIGS. 2*a* and 2*b*, the rolling mill stand 400 further comprises work roll bending cylinders 610 each provided in a respective one of the support blocks 402*b-g*, 404*b-g* such as to be located at or in one of the opposing upper channel formations 406*a* or opposing lower channel formations 406*b*. The work roll bending cylinders 610 are hydraulically operated. Each of the work roll bending cylinders 610 is configured to engage a respective one of the bending wings 506*a*, 508*a* and to be selectively extendable and retractable in the vertical direction (i.e. in the Z dimension) in order to raise and lower a respective one of the upper work roll 502 and the lower work roll 504. It will be understood by the skilled person that the work roll bending cylinders 610 function to control the gap (or roll bite) between the upper and lower work rolls 502, 504 during rolling operations.

In this example, the upper and lower work rolls 502, 504 are each supported by a respective backup roll (not shown in the Figures). The longitudinal axes of the upper and lower work rolls 502, 504 and the backup rolls lie in a single, common plane (a vertical plane, in the sense of FIGS. 2*a*-6). In this example, hydraulic roll load cylinders (not shown in the Figures) are arranged to apply a rolling force to the upper work roll 502 via its respective backup roll. The position of the lower work roll 504 and its respective backup roll may be set, for example, by a pair of wedges located at the base of the rolling mill stand 400. In this example, the upper and lower work rolls 502, 504 are constructed from steel.

The upper and lower work rolls 502, 504 will tend to become worn during rolling operations and they are therefore periodically removed from the rolling mill stand 400 for replacement. The procedure for removing and replacing the work roll assembly 400 will now be described with reference to FIGS. 2*a*-6.

Referring firstly to FIGS. 2*a* and 2*b*, initially each of the first and second movable rails 414, 416 is in the idle position and each of the upper work rolls chocks 506 and the lower work roll chocks 508 is supported by the respective bending cylinders 610. Furthermore the strip of metallic product P' is located in the gap between the upper and lower work rolls 502, 504 such as to be in contact with the upper and lower work rolls 502, 504. Thus the rolling mill stand 400 is initially in a condition for rolling the strip of metallic product P'. In this example, the rolling mill stand 400 is for hot rolling. In other examples, the rolling mill stand 400 may be for cold rolling. In this example, the strip of metallic product P' comprises steel. In other examples, the strip of metallic product P' may comprise a different metal or metal alloy, for example aluminium or aluminium alloy.

The rolling operation may be brought to a halt so that the strip of metallic product P' is stationary. Alternatively the rolling operation may be continued so that the metallic product P is in motion during the changing of the work roll assembly 400.

The work roll bending cylinders 610 which support the lower work roll chocks 508 are controlled to be retracted downwardly (i.e. in the −Z direction) into the respective support blocks 402*d*, 402*g*. Accordingly the lower work roll 504 is lowered (i.e. in the −Z direction) so that each of the wheels 508*b* of the lower work roll chocks 508 comes into resting contact with the upper surface of a respective one of the lower fixed rails 412*a*, 412*b*. As the lower work roll 504 is moved downwardly in this way it separates from the strip of metallic product P'.

The work roll bending cylinders 610 which support the upper work roll chocks 506 are controlled to be extended upwardly (i.e. in the +Z direction) from the respective support blocks 402*c*, 402*f*. Accordingly the upper work roll 502 is raised (i.e. in the +Z direction) so that each of the wheels 506*b* of the upper work roll chocks 506 is raised slightly above the level of (i.e. further in the +Z direction than) the upper surface of a respective one of the upper fixed rails 410*a*, 410*b* and the upper surfaces of the respective first and second movable rails 414, 416. Furthermore each bending wing 506*a* of each upper work roll chock 506 is also above the level of (i.e. further in the +Z direction than) the upper surface of the respective one of the upper fixed rails 410*a*, 410*b* and the upper surfaces of the respective first and second movable rails 414, 416.

As the upper work roll 502 is moved upwardly in this way it separates from the strip of metallic product P'. Preferably the upward movement (i.e. in the +Z direction) of the upper work roll 502 is simultaneous with the downward movement (i.e. in the −Z direction) of the lower work roll 504. In this case the upper work roll 502 and the lower work roll 504 may be separated from the strip of metallic product P' at substantially the same time. Alternatively, the downward movement of the lower work roll 504 may be prior to the upward movement of the upper work roll 502. In this case the strip of metallic product P' is no longer supported by the lower work roll 504 and tends to sag downwardly such as to separate from the upper work roll 502.

Figure 3A:
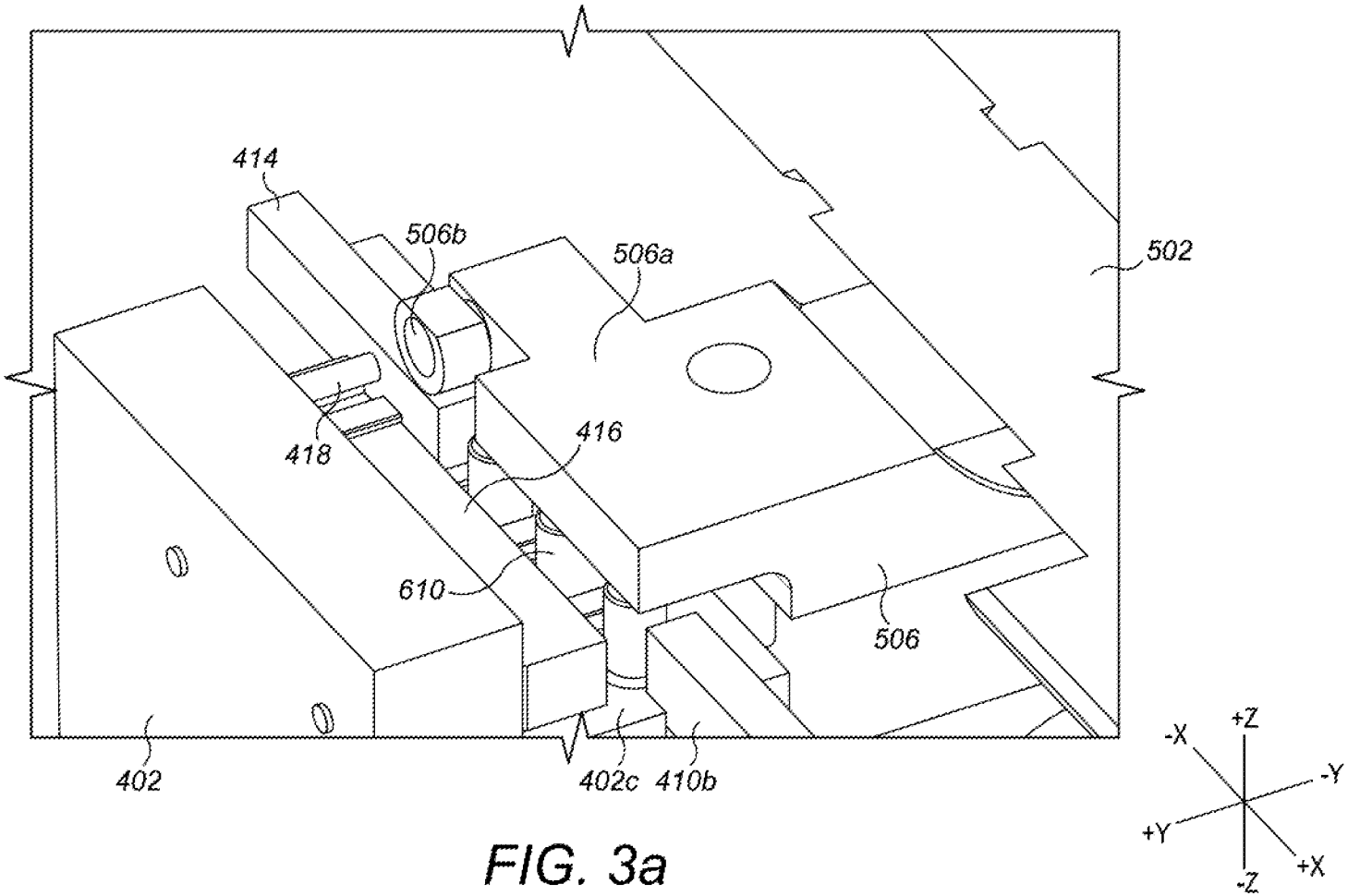
Figure 3B:
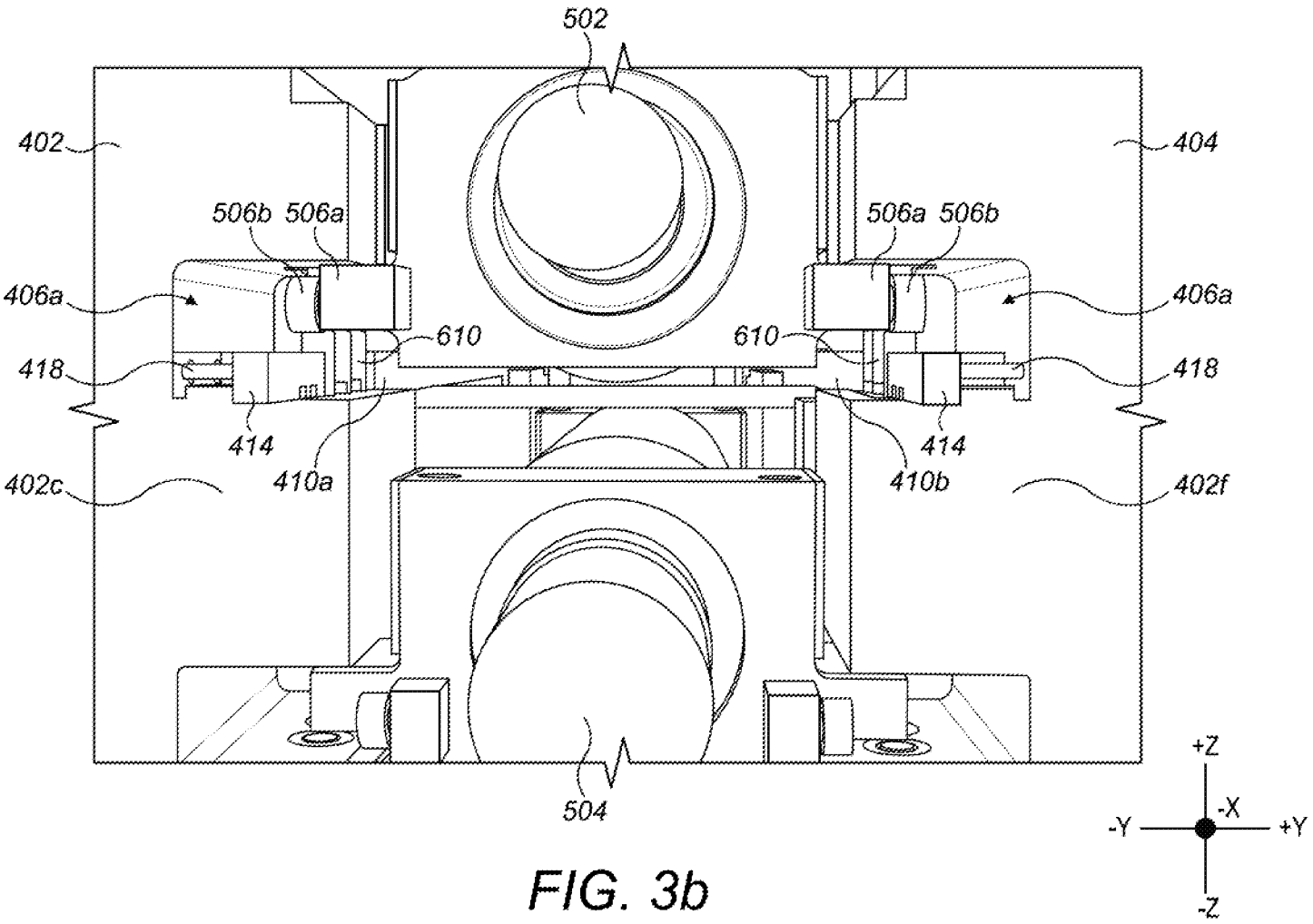

Referring next to FIGS. 3*a* and 3*b*, with respect to each of the windows 402*a*, 404*a* of the first and second support members 402, 404 the hydraulic piston 418 of each first movable rail 414 is controlled to be extended so as to move the first movable rail 414 from the idle position into the service position. Since the respective wheel 506*b* of the respective upper work roll chock 506 has already been set at a position which is slightly higher (i.e. in the Z dimension) than the first movable rail 414, the movement (i.e. in the Y dimension) of the first movable rail 414 into the service position is unimpeded by the wheel 506*b*. Furthermore, there exists a small vertical gap (i.e. in the Z dimension) between the upper surface of the first movable rail 414 and the wheel 506*b* when the first movable rail 414 is located directly below the wheel 506*b* in the service position.

Figure 4A:
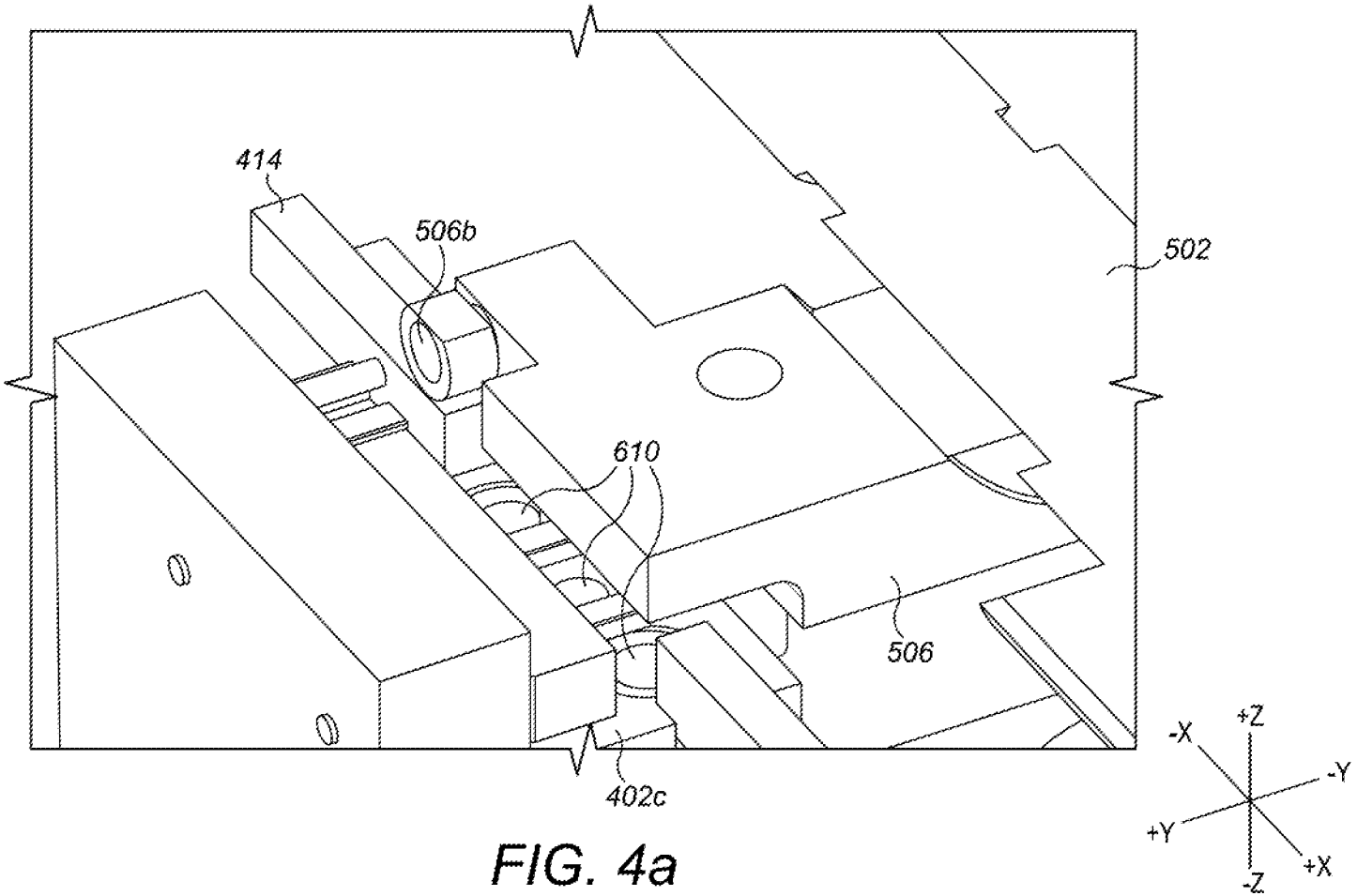
Figure 4B:
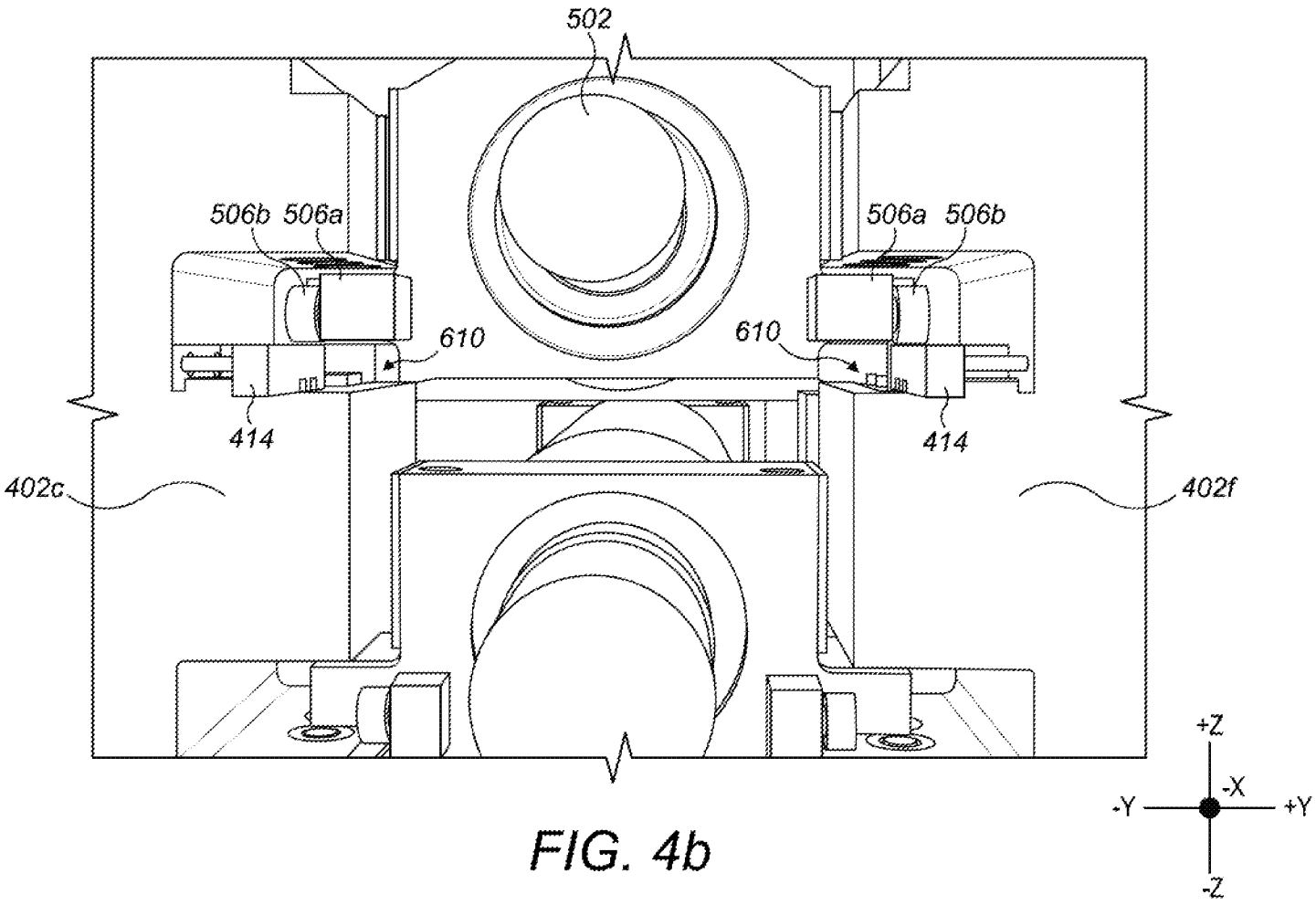

Referring next to FIGS. 4*a* and 4*b*, with respect to each of the windows 402*a*, 404*a* of the first and second support members 402, 404 the work roll bending cylinders 610 which still support the upper work roll chocks 506 are controlled to be retracted downwardly (i.e. in the −Z direction) into the respective support blocks 402*c*, 402*f*. Accordingly the upper work roll 502 is lowered (i.e. in the −Z direction) so that each of the wheels 506*b* of the upper work roll chocks 506 is lowered and comes into resting contact with the upper surface of a respective one of the first movable rails 414. The work roll bending cylinders 610 are further and fully retracted so as to be flush with (or slightly below) the surfaces of the respective support blocks 402*c*, 402*f*. Thus the upper work roll 502 is supported (only) by the first movable rails 414.

Figure 5A:
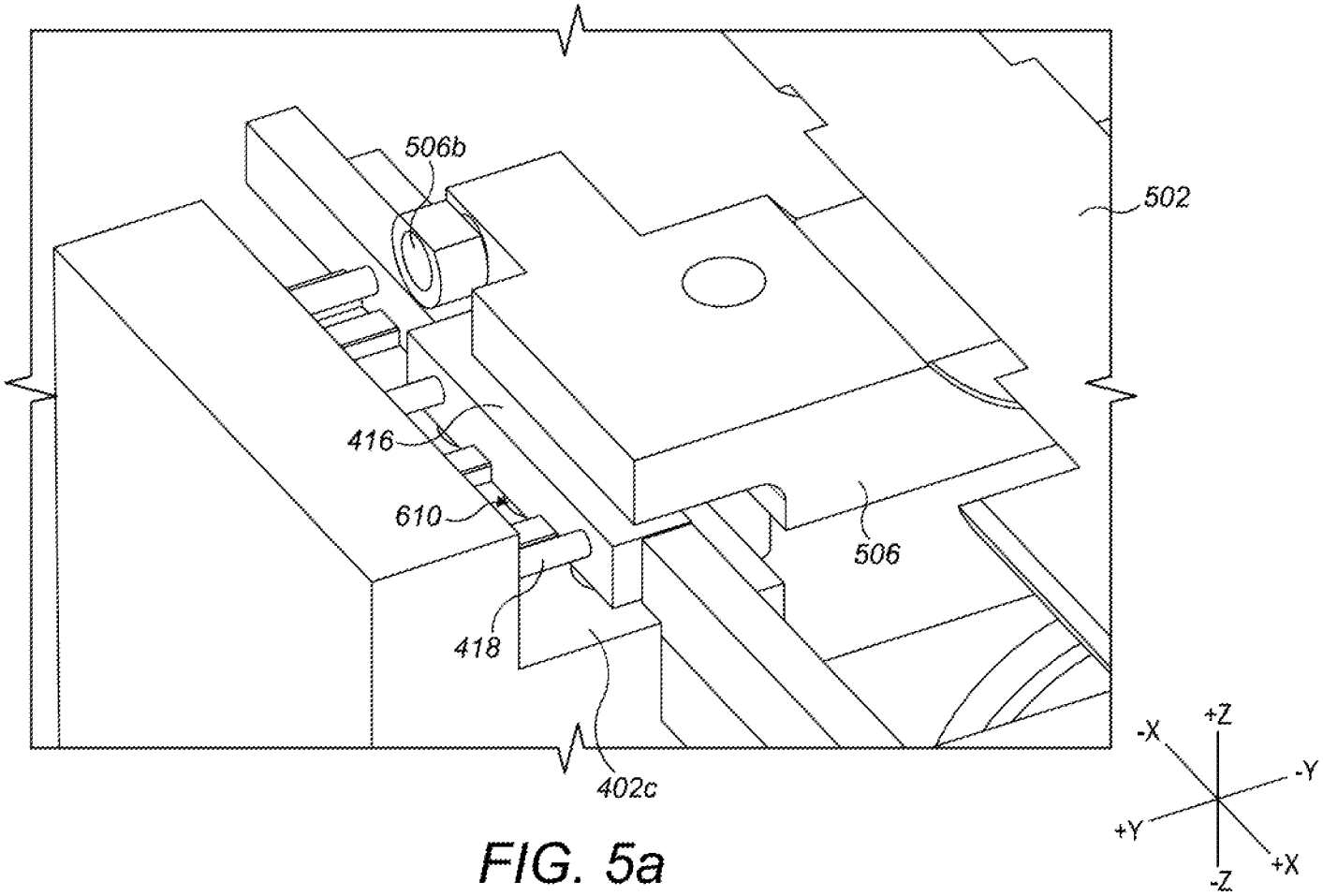
Figure 5B:
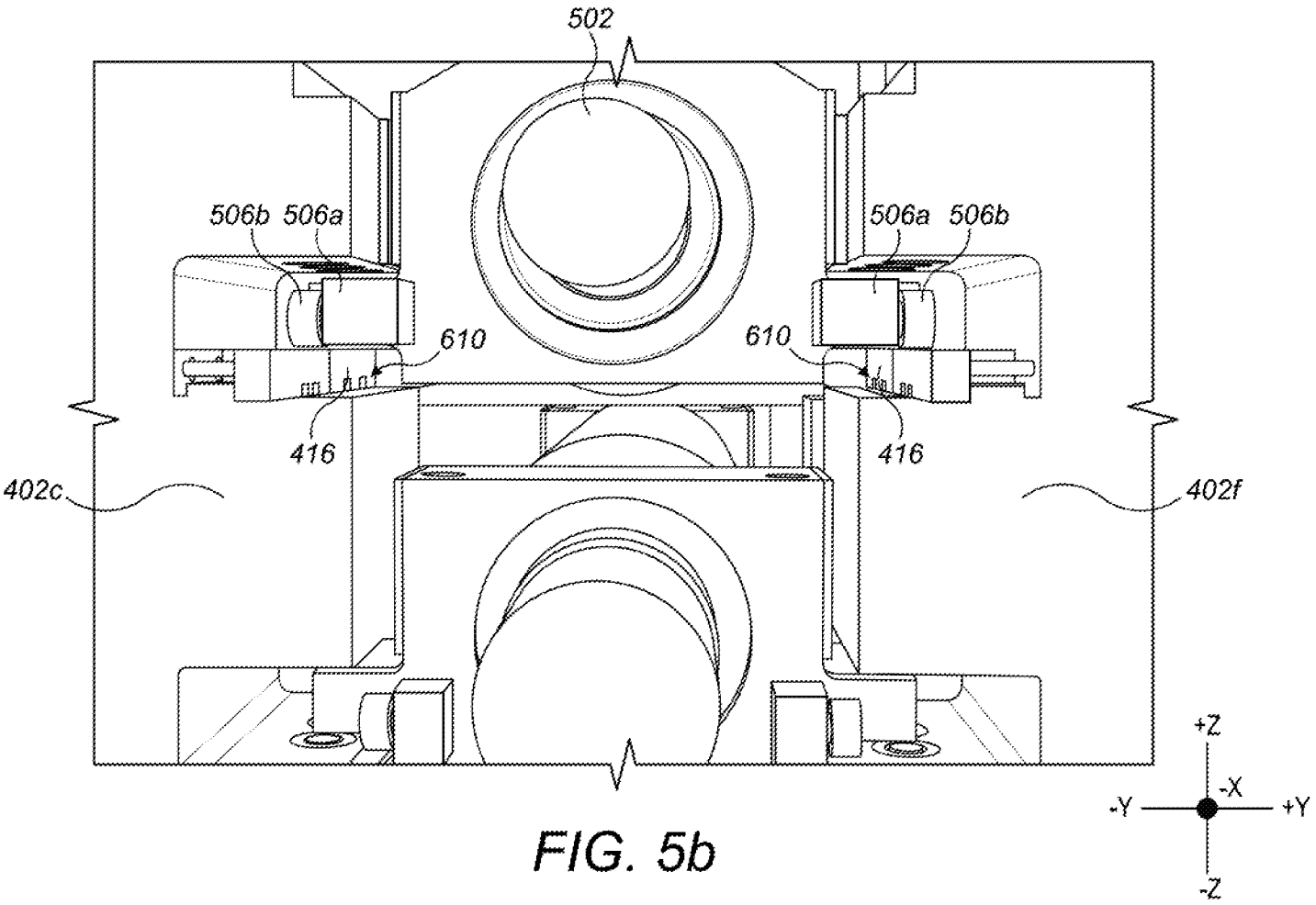
Figure 6:
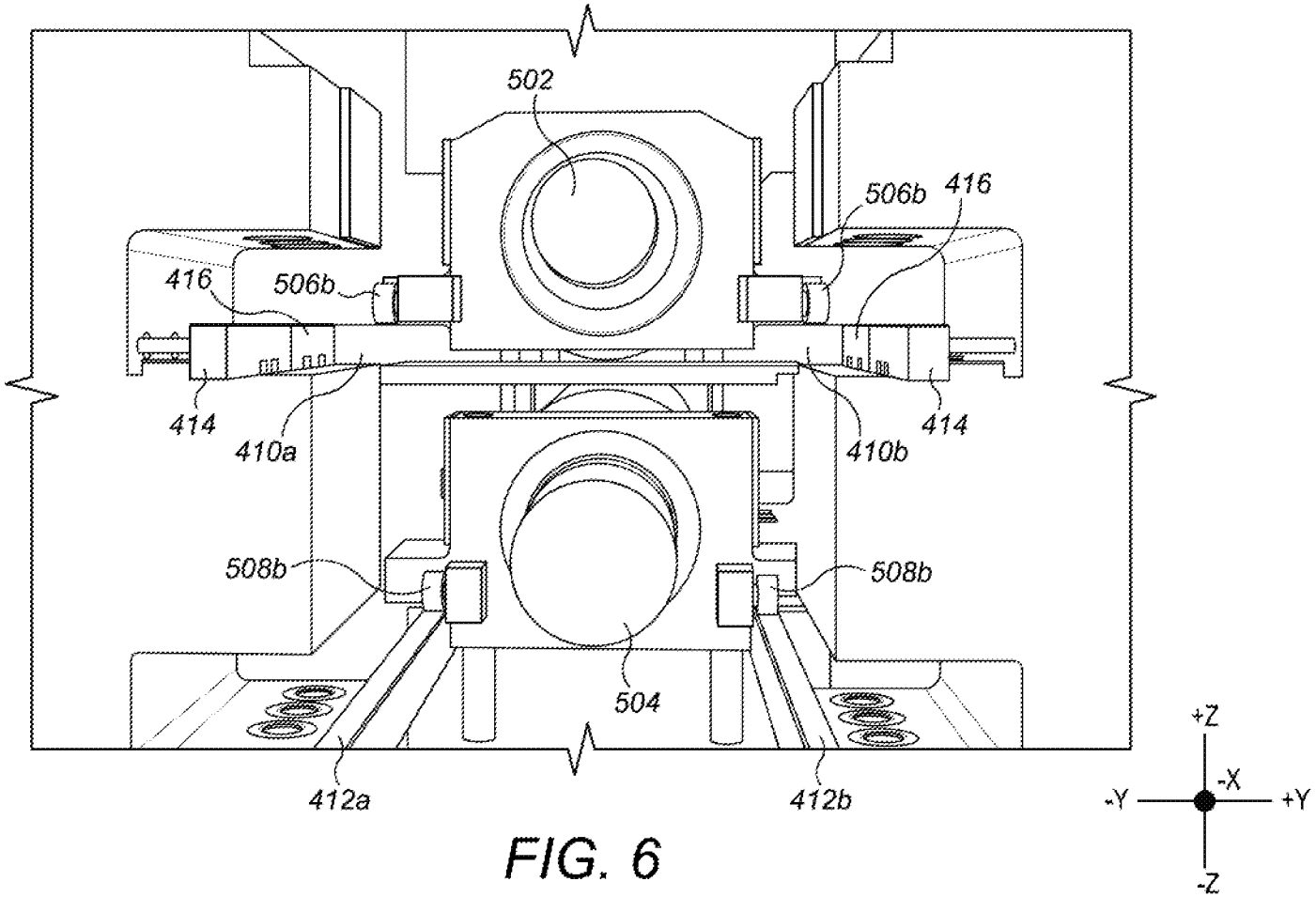

Referring next to FIGS. 5*a* and 5*b*, with respect to each of the windows 402*a*, 404*a* of the first and second support members 402, 404 the hydraulic piston 418 of each second movable rail 416 is controlled to be extended so as to move the second movable rail 416 from the idle position into the service position. Since the work roll bending cylinders 610 are flush with (or slightly below) the surfaces of the respective support blocks 402*c*, 402*f*, the movement (i.e. in the Y dimension) of the second movable rail 416 into the service position is unimpeded by the work roll bending cylinders 610. Furthermore, the second movable rail 416 is located directly above the work roll bending cylinders 610 and directly below the respective bending wing 506*a* of the respective upper work roll chock 506 when the second movable rail 416 is in the service position. Furthermore, there exists a small vertical gap (i.e. in the Z dimension) between the upper surface of the second movable rail 416 and the lower surface of the respective bending wing 506*a* of the respective upper work roll chock 506 when the second movable rail 416 is in the service position.

When placed in their service positions as described herein above, the first and second movable rails 414, 416 together with their respective first or second upper fixed rail 410*a*, 410*b* form a continuous rail which extends substantially the full width of the rolling mill stand 400 (i.e. in the X dimension). Thus there exists parallel first and second continuous rails associated with the upper work roll 502 and first and second continuous rails associated with the lower work roll 504, each of the continuous rails extending substantially the full width of the rolling mill stand 400 (i.e. in the X dimension).

In this example, the rolling mill stand 400 further comprises four extension rails (not shown in the Figures) which project outwardly from one of the first and second support members 402, 404 (i.e. in the X dimension and in one of the −X and +X directions) such that each one of the four extension rails aligns with (i.e. in the X dimension) and is in end-to-end abutment with one of the above-mentioned continuous rails. In an alternative example, there is provided a separate locomotive or carriage comprising four extension rails, the carriage being movable (i.e. in the X dimension) to bring each of the four extension rails into end-to-end abutment and alignment (i.e. in the X dimension to the operating side) with one of the above-mentioned continuous rails. In each case, the four extension rails are constructed from steel.

A pushing or pulling force is applied to the work roll assembly 500 in the axial direction (i.e. in the +X or −X direction), for example manually by an operator or by automated means, in order to withdraw the work roll assembly 500 from the operating side of the rolling mill stand 400 along the four extension rails.

The removal procedure may be performed in reverse in order to install a replacement work roll assembly in the rolling mill stand 400, as follows.

The replacement work roll assembly is moved along the four extension rails (i.e. in the X dimension to the operating side) to insert the work roll assembly into the rolling mill stand 400 so that each of the wheels 506*b*' of the upper work roll chocks is resting on the upper surface of a respective one of the first movable rails 414 (which are each in their service position) and each of the wheels 508*b*' of the lower work roll chocks is resting on the upper surface of a respective one of the lower fixed rails 412*a*, 412*b*.

With respect to each of the windows 402*a*, 404*a* of the first and second support members 402, 404 the hydraulic piston 418 of each second movable rail 416 is controlled to be retracted so as to move the second movable rail 416 from the service position into the idle position.

With respect to each of the windows 402*a*, 404*a* of the first and second support members 402, 404 the work roll bending cylinders 610 are controlled to be extended upwardly (i.e. in the +Z direction) from the respective support blocks 402*c*, 402*f*. Accordingly the upper work roll is raised (i.e. in the +Z direction) so that each of the wheels of the upper work roll chocks is raised slightly above the level of (i.e. further in the +Z direction than) the upper surface of a respective one of the upper fixed rails 410*a*, 410*b* and the upper surfaces of the respective first and second movable rails 414, 416. Furthermore each bending wing of each upper work roll chock is also above the level of (i.e. further in the +Z direction than) the upper surface of the respective one of the upper fixed rails 410*a*, 410*b* and the upper surfaces of the respective first and second movable rails 414, 416. Thus the upper work roll is supported (only) by the work roll bending cylinders 610 which are engaged with the respective bending wing of each upper work roll chock.

With respect to each of the windows 402*a*, 404*a* of the first and second support members 402, 404 the hydraulic piston 418 of each first movable rail 414 is controlled to be retracted so as to move the first movable rail 414 from the service position into the idle position.

The work roll bending cylinders 610 which support the upper work roll chocks are controlled to be retracted downwardly (i.e. in the −Z direction). Accordingly the upper work roll is lowered (i.e. in the −Z direction). As the lower work roll is moved downwardly in this way it comes into contact with the strip of metallic product P'.

The work roll bending cylinders 610 which relate to the lower work roll chocks are controlled to be extended upwardly (i.e. in the −Z direction) from the respective support blocks 402*d*, 402*g*. Accordingly the lower work roll is raised (i.e. in the +Z direction) so that each of the wheels of the lower work roll chocks is lifted off the upper surface of a respective one of the lower fixed rails 412*a*, 412*b*. As the lower work roll is moved upwardly in this way it comes into contact with the strip of metallic product P'.

Thus the strip of metallic product P' is located in the gap between the upper and lower work rolls such as to be in contact with the upper and lower work rolls. Accordingly the rolling mill stand 400 is in the condition for rolling the strip of metallic product P'.

The rolling mill stand 400 comprises a controller 700 for controlling the extension and retraction of the work roll bending cylinders 610, as will be understood by the person skilled in the art.

The hydraulic pistons 418 which actuate the first and second movable rails 414, 416 may be connected with the same hydraulic system and controller as the work roll bending cylinders 610, or a different hydraulic system and controller.

While in the above example each of the upper work roll chocks and the lower work roll chocks comprises a wheel, in other examples the upper and lower work roll chocks comprise a different transportation element, for example a low-friction block or skid. All such transportation elements are within the scope of the claimed invention, provided that they are configured to engage with the respective rails in order to guide the work roll assembly 200 in and out of the rolling mill stand 100.

It should be understood that the invention has been described in relation to its preferred embodiments and may be modified in many different ways without departing from the scope of the invention as defined by the accompanying claims.

The invention claimed is:

1. A rolling mill stand for rolling a metallic product, comprising:

first and second supports spaced apart from each other in an X dimension and each defining a window that extends in a Y dimension which is perpendicular with the X dimension, each window comprising opposing upper channel formations and opposing lower channel formations;

upper fixed rails, each extending in the X dimension between a respective one of the opposing upper channel formations of the first support and a respective one of the opposing upper channel formations of the second support;

lower fixed rails, each extending in the X dimension between a respective one of the opposing lower channel formations of the first support and a respective one of the opposing lower channel formations of the second support;

a work roll assembly comprising an upper work roll and a lower work roll each having a longitudinal axis extending in the X dimension, the upper work roll and the lower work roll being arranged to be spaced apart so as to form a gap for receiving the metallic product for rolling in the Y dimension, two ends of the upper work roll being received by respective upper work roll chocks and two ends of the lower work roll being received by respective lower work roll chocks, each of the upper work roll chocks and the lower work roll chocks comprising bending wings which extend in the Y dimension, each of the bending wings comprising at least one transportation element, each of the bending wings of the upper work roll chock being slidingly received in a respective one of the opposing upper channel formations and each of the bending wings of the lower work roll chock being slidingly received in a respective one of the opposing lower channel formations; and work roll bending cylinders each located in one of the opposing upper channel formations or opposing lower channel formations and configured to engage a respective one of the bending wings, each of the work roll bending cylinders being arranged to be selectively extendable and retractable in a Z dimension which is perpendicular with each of the X and Y dimensions in order to raise and lower a respective one of the upper work roll and the lower work roll, wherein with respect to each said window there is provided first and second movable rails located at each of the opposing upper channel formations or at each of the opposing lower channel formations, each of the first and second movable rails being independently movable in the Y dimension between an idle position which is out of alignment with a respective one of the upper or lower fixed rails in the X dimension and a service position which is in alignment therewith in the X dimension, and wherein:

when the first and second movable rails are in the idle positions movement of the bending wings in the Z dimension is unimpeded by the first and second movable rails; and when the first and second movable rails are in the service positions the first and second movable rails together with the respective fixed rail form a continuous rail for guiding respective said transportation elements of the bending wings in the X dimension in order to selectively withdraw the work roll assembly from the rolling mill stand and insert the work roll assembly in the rolling mill stand.

2. A rolling mill stand according to claim 1, wherein with respect to each said window, the first and second movable rails are located at each of the opposing upper channel formations.

3. A rolling mill stand according to claim 1, wherein with respect to each said window, the first and second movable rails are located at each of the opposing lower channel formations.

4. A rolling mill stand according to claim 1, wherein each of the first and second movable rails is independently movable in the Y dimension:

toward the longitudinal axis of the upper work roll or the lower work roll from the idle position to the service position; and away from the longitudinal axis of the upper work roll or the lower work roll from the service position to the idle position.

5. A rolling mill stand according to claim 1, further comprising hydraulic actuators arranged to move the first and second movable rails between the idle position and the service position.

6. A rolling mill stand according to claim 1, further comprising a guide for guiding the first and second movable rails in the Y dimension while resisting movement of the first and second movable rails in the X dimension.

7. A rolling mill stand according to claim 6, wherein the guide comprises:

one of a complementary ridge and a channel is provided on a surface of each of said opposing upper channel formations or said opposing lower channel formations and extending in the Y dimension; and the other of the complementary ridge and the channel is provided on each of the first and second movable rails and extending in the Y dimension, the ridge being received by the channel.

8. A rolling mill stand according to claim 1, further comprising a plurality of extension rails each extending in the X dimension from one of the first and second supports, each of the extension rails being in alignment and in end-to-end abutment with one of said continuous rails and being configured to guide said respective said transportation elements.

9. A rolling mill stand according to claim 8, wherein the extension rails form an integral part of said one of the first and second supports.

10. A rolling mill stand according to claim 8, wherein the extension rails form parts of a carriage which is movable in the X dimension so as to bring the extension rails into said alignment and end-to-end abutment with said continuous rails.

11. A rolling mill stand according to claim 1, wherein the at least one transportation element comprises a wheel.

12. A method of changing a work roll assembly of a rolling mill stand according to claim 2, the method comprising:

providing the rolling mill stand according to claim 2;

controlling the work roll bending cylinders which are located in the opposing lower channel formations and which are in engagement with the bending wings of the lower work roll chocks to be retracted, thereby lowering to lower the lower work roll in the Z dimension so as to separate the lower work roll from the metallic product and to bring each of the transportation elements of the lower work roll chocks into contact with a respective one of the lower fixed rails;

controlling the work roll bending cylinders which are located in the opposing upper channel formations and which are in engagement with the bending wings of the upper work roll chocks to be extended, thereby raising the upper work roll in the Z dimension so as to separate the upper work roll from the metallic product and to bring each of the transportation elements of the upper work roll to a greater height than the respective first movable rail;

controlling each first movable rail to move from the idle position into the service position;

controlling the work roll bending cylinders which are located in the opposing upper channel formations and which are in engagement with the bending wings of the upper work roll chocks to be retracted, thereby lowering the upper work roll in the Z dimension to bring each of the transportation elements of the upper work roll chocks into contact with a respective one of the first movable rails;

controlling each second movable rail to move from the idle position into the service position;

applying a force to the work roll assembly in the X dimension in order to guide each of the transportation elements along a respective one of the continuous rails or a respective one of the lower fixed rails, thereby withdrawing to, the work roll assembly from the rolling mill stand;

providing a replacement work roll assembly comprising upper and lower replacement work rolls, two ends of the upper replacement work roll being received by respective upper replacement work roll chocks and two ends of the lower replacement work roll being received by respective lower replacement work roll chocks, each of the upper and lower replacement work roll chocks comprising replacement bending wings, each of the replacement bending wings comprising at least one transportation element;

applying a force to the replacement work roll assembly in the X dimension in order to guide each of the replacement transportation elements along a respective one of the continuous rails or a respective one of the lower fixed rails, thereby inserting the replacement work roll assembly into the rolling mill stand;

controlling each second movable rail to move from the service position into the idle position;

controlling the work roll bending cylinders which are located in the opposing upper channel formations to be extended, thereby engaging to engage with the replacement bending wings of the upper replacement work roll chocks to raise the upper replacement work roll in the Z dimension so as to lift each of the replacement transportation elements of the upper replacement work roll off the respective first movable rail;

controlling each first movable rail to move from the service position into the idle position;

controlling the work roll bending cylinders which are located in the opposing upper channel formations and which are in engagement with the replacement bending wings of the upper replacement work roll chocks to be retracted, thereby lowering to lower the upper replacement work roll in the Z dimension to bring the upper replacement work roll into contact with the metallic product; and controlling the work roll bending cylinders which are located in the opposing lower channel formations to be extended, thereby engaging to engage with the replacement bending wings of the lower replacement work roll chocks to raise the lower replacement work roll in the Z dimension so as to lift each of the replacement transportation elements of the lower replacement work roll off the respective one of the lower fixed rails and to bring the lower replacement work roll into contact with the metallic product.

13. A method of changing a work roll assembly of a rolling mill stand according to claim 3, the method comprising:

providing the rolling mill stand according to claim 3;

controlling the work roll bending cylinders which are located in the opposing upper channel formations and which are in engagement with the bending wings of the upper work roll chocks to be retracted, thereby lowering the upper work roll in the Z dimension so as to bring each of the transportation elements of the upper work roll chocks into contact with a respective one of the upper fixed rails;

controlling the work roll bending cylinders which are located in the opposing lower channel formations and which are in engagement with the bending wings of the lower work roll chocks to be retracted, thereby lowering the lower work roll in the Z dimension so as to separate the lower work roll from the metallic product and to allow the metallic product to sag so as to separate from the upper work roll;

controlling the work roll bending cylinders which are located in the opposing lower channel formations and which are in engagement with the bending wings of the lower work roll chocks to be retracted or extended, thereby bringing each of the transportation elements of the lower work roll chocks to a greater height than the respective first movable rail;

controlling each first movable rail to move from the idle position into the service position;

controlling the work roll bending cylinders which are located in the opposing lower channel formations and which are in engagement with the bending wings of the lower work roll chocks to be retracted, thereby lowering the lower work roll in the Z dimension to bring each of the transportation elements of the lower work roll chocks into contact with a respective one of the first movable rails;

controlling each second movable rail to move from the idle position into the service position;

applying a force to the work roll assembly in the X dimension in order to guide each of the transportation elements along a respective one of the continuous rails or a respective one of the lower fixed rails, thereby withdrawing the work roll assembly from the rolling mill stand;

providing a replacement work roll assembly comprising upper and lower replacement work rolls, two ends of the upper replacement work roll being received by respective upper replacement work roll chocks and two ends of the lower replacement work roll being received by respective lower replacement work roll chocks, each of the upper and lower replacement work roll chocks comprising replacement bending wings, each of the replacement bending wings comprising at least one transportation element;

applying a force to the replacement work roll assembly in the X dimension in order to guide each of the replacement transportation elements along a respective one of the continuous rails or a respective one of the upper fixed rails, thereby inserting to insert the replacement work roll assembly into the rolling mill stand;

controlling the work roll bending cylinders which are located in the opposing upper channel formations to be extended, thereby engaging to engage with the replacement bending wings of the upper replacement work roll chocks to raise the upper replacement work roll in the Z dimension so as to lift each of the replacement transportation elements of the upper replacement work roll off the respective one of the upper fixed rails;

controlling each second movable rail to move from the service position into the idle position;

controlling the work roll bending cylinders which are located in the opposing lower channel formations to be extended, thereby engaging with the replacement bending wings of the lower replacement work roll chocks to raise the lower replacement work roll in the Z dimension so as to lift each of the replacement transportation elements of the lower replacement work roll off the respective first movable rail, controlling each first movable rail to move from the service position into the idle position; and controlling the work roll bending cylinders which are located in the opposing lower channel formations and which are in engagement with the replacement bending wings of the lower replacement work roll chocks to be extended, thereby raising the lower replacement work roll in the Z dimension to bring the lower replacement work roll into contact with the metallic product and to move the metallic product into contact with the upper replacement work roll.

14. A method according to claim 12, wherein the metallic product (P') is stationary in the Y dimension with respect to the rolling mill stand.

15. A method according to claim 12, wherein the metallic product (P') is in motion in the Y dimension with respect to the rolling mill stand.

* * * * *